US012740586B2

(12) United States Patent
Kim et al.

(10) Patent No.: US 12,740,586 B2
(45) Date of Patent: Sep. 22, 2026

(54) AEROSOL-GENERATING ARTICLE AND METHOD OF MANUFACTURING THE SAME

(71) Applicant: KT&G CORPORATION, Daejeon (KR)

(72) Inventors: Han Saem Kim, Daejeon (KR); Yeon Seok Jung, Daejeon (KR); Rak Un Park, Daejeon (KR); Jung Lae Lee, Daejeon (KR)

(73) Assignee: KT&G CORPORATION, Daejeon (KR)

( * ) Notice: Subject to any disclaimer, the term of this patent is extended or adjusted under 35 U.S.C. 154(b) by 606 days.

(21) Appl. No.: 17/777,517

(22) PCT Filed: Jul. 13, 2021

(86) PCT No.: PCT/KR2021/008975
§ 371 (c)(1),
(2) Date: May 17, 2022

(87) PCT Pub. No.: WO2022/035064
PCT Pub. Date: Feb. 17, 2022

(65) Prior Publication Data

US 2023/0354885 A1 Nov. 9, 2023

(30) Foreign Application Priority Data

Aug. 10, 2020 (KR) ..... 10-2020-0099767

(51) Int. Cl.
*A24D 1/20* (2020.01)
*A24B 3/12* (2006.01)
(Continued)

(52) U.S. Cl.
CPC ..... *A24D 1/20* (2020.01); *A24B 3/12* (2013.01); *A24B 3/14* (2013.01); *A24B 7/08* (2013.01);
(Continued)

(58) Field of Classification Search
CPC ... A24C 5/01; A24D 1/20; A24D 3/04; A24D 3/048; A24D 3/17; A24D 3/18
See application file for complete search history.

(56) References Cited

U.S. PATENT DOCUMENTS 3,968,804 A * 7/1976 Kelly ..... A24B 3/14 131/370
4,821,749 A * 4/1989 Toft ..... A24B 3/14 131/297
(Continued)

FOREIGN PATENT DOCUMENTS

CN 108601407 A 9/2018
CN 211153787 U 8/2020
(Continued)

OTHER PUBLICATIONS

Communication dated Apr. 25, 2022 in Russian Application No. 2021133740/03(071288).
(Continued)

*Primary Examiner* — Michael H. Wilson
*Assistant Examiner* — Stephanie Lynn Moore
(74) *Attorney, Agent, or Firm* — Sughrue Mion, PLLC

(57) ABSTRACT

An aerosol-generating article and a method of manufacturing the same capable of simultaneously improving satisfaction with a tobacco smoke taste and allowing the aerosol-generating article to be manufactured at low cost are provided. The aerosol-generating article according to some embodiments of the present disclosure may include an aerosol-forming substrate portion which includes shredded tobacco leaves and is configured to form an aerosol when electrically heated by an aerosol generation device and a mouthpiece portion which is disposed downstream of the aerosol-forming substrate portion to form a downstream end of the aerosol-generating article. Since the shredded tobacco leaves are cheaper than a reconstituted tobacco sheet, manu-
(Continued)

facturing costs of the aerosol-generating article may be reduced. Also, unlike the reconstituted tobacco sheet, since the amount of supplementary materials added to the shredded tobacco leaves is small, an off-taste may be reduced, and thus user satisfaction with a tobacco smoke taste may be improved.

16 Claims, 8 Drawing Sheets

(51) Int. Cl.

| | |
|---|---|
| ***A24B 3/14*** | (2006.01) |
| ***A24B 7/08*** | (2006.01) |
| ***A24B 13/02*** | (2006.01) |
| ***A24C 1/34*** | (2006.01) |
| ***A24C 5/18*** | (2006.01) |
| ***A24C 5/47*** | (2006.01) |
| ***A24D 1/04*** | (2006.01) |

(52) U.S. Cl.
CPC ..... *A24B 13/02* (2013.01); *A24C 1/34* (2013.01); *A24C 5/18* (2013.01); *A24C 5/47* (2013.01); *A24D 1/042* (2013.01)

(56) References Cited

U.S. PATENT DOCUMENTS

| | | | | |
|---|---|---|---|---|
| 4,928,714 | A * | 5/1990 | Shannon | A24D 1/22 131/273 |
| 5,067,499 | A * | 11/1991 | Banerjee | A24D 1/22 131/194 |
| 5,499,636 | A | 3/1996 | Baggett, Jr. et al. | |
| 2005/0066986 | A1* | 3/2005 | Nestor | A24D 1/00 131/360 |
| 2007/0074734 | A1 | 4/2007 | Braunshteyn et al. | |
| 2008/0092912 | A1 | 4/2008 | Robinson et al. | |
| 2010/0154808 | A1 | 6/2010 | Boll et al. | |
| 2010/0200006 | A1* | 8/2010 | Robinson | A24F 40/42 131/194 |
| 2014/0190496 | A1* | 7/2014 | Wensley | A61M 11/001 131/273 |
| 2014/0290678 | A1* | 10/2014 | Besso | A24D 3/04 131/337 |
| 2014/0373856 | A1* | 12/2014 | Zuber | A24F 47/00 131/328 |
| 2019/0021392 | A1* | 1/2019 | Minzoni | A24D 3/04 |
| 2022/0125101 | A1* | 4/2022 | Hepworth | A24D 3/061 |

FOREIGN PATENT DOCUMENTS

| | | | |
|---|---|---|---|
| JP | 2003-219 | A | 1/2003 |
| JP | 2019-515658 | A | 6/2019 |
| JP | 2020-519281 | A | 7/2020 |
| KR | 10-2018-0069092 | A | 6/2018 |
| KR | 10-2019-0093026 | A | 8/2019 |
| KR | 10-2019-0136081 | A | 12/2019 |
| KR | 10-2020-0018354 | A | 2/2020 |
| KR | 10-2020-0061130 | A | 6/2020 |
| RU | 2044506 | C1 | 9/1995 |
| WO | 2019/105950 | A1 | 6/2019 |
| WO | 2019/151687 | A1 | 8/2019 |
| WO | 2020/032715 | A1 | 2/2020 |
| WO | 2020/071089 | A1 | 4/2020 |
| WO | 2020/089085 | A1 | 5/2020 |
| WO | 2020/115897 | A1 | 6/2020 |

OTHER PUBLICATIONS

Japanese Office Action issued May 30, 2023, in Application No. 2021-561974.
Office Action issued Nov. 29, 2022 in Japanese Application No. 2021-561974.
Supplementary European Search Report issued Nov. 14, 2022 in European Application No. 21805336.1.
International Search Report of PCT/KR2021/008975 dated Oct. 26, 2021 [PCT/ISA/210].
Chinese Office Action dated Dec. 27, 2025, issued in Chinese application No. 202311635524.3.
European Office Action dated Mar. 2, 2026, issued in European application No. 21805336.1.

* cited by examiner

[FIG. 1]
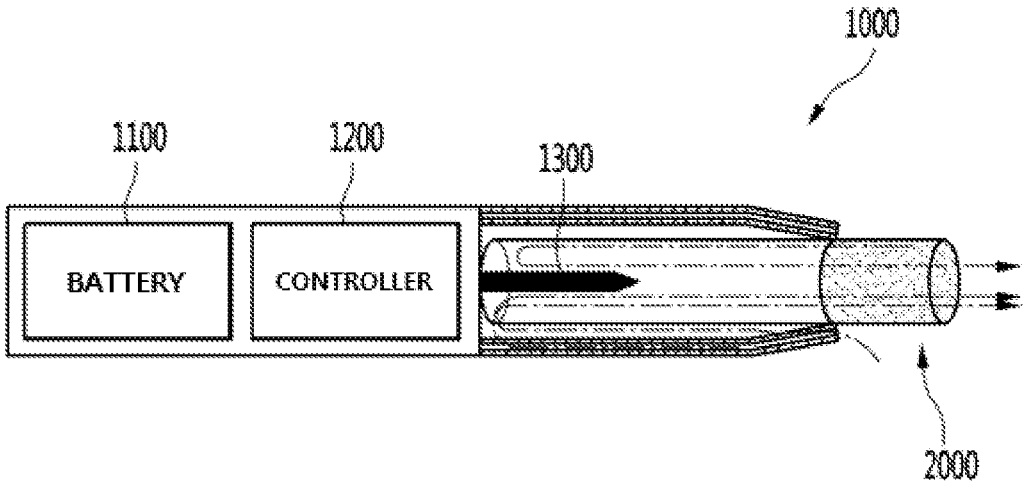
[FIG. 2]
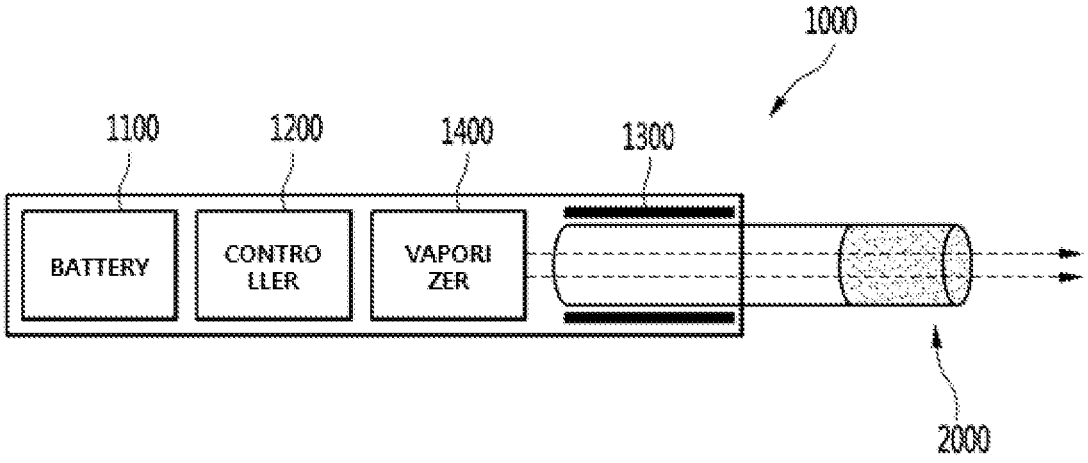

[FIG. 3]
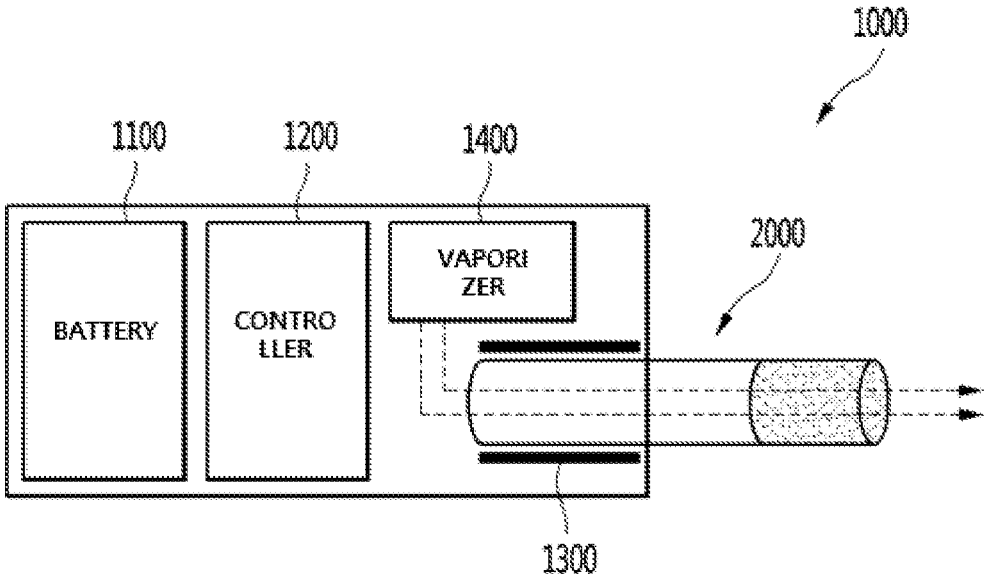
[FIG.4]
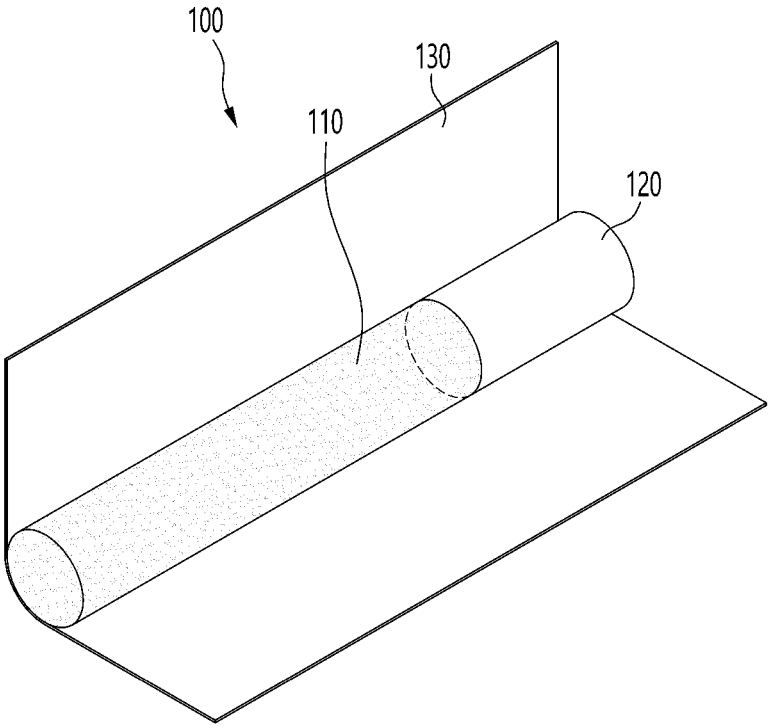

[FIG.5]
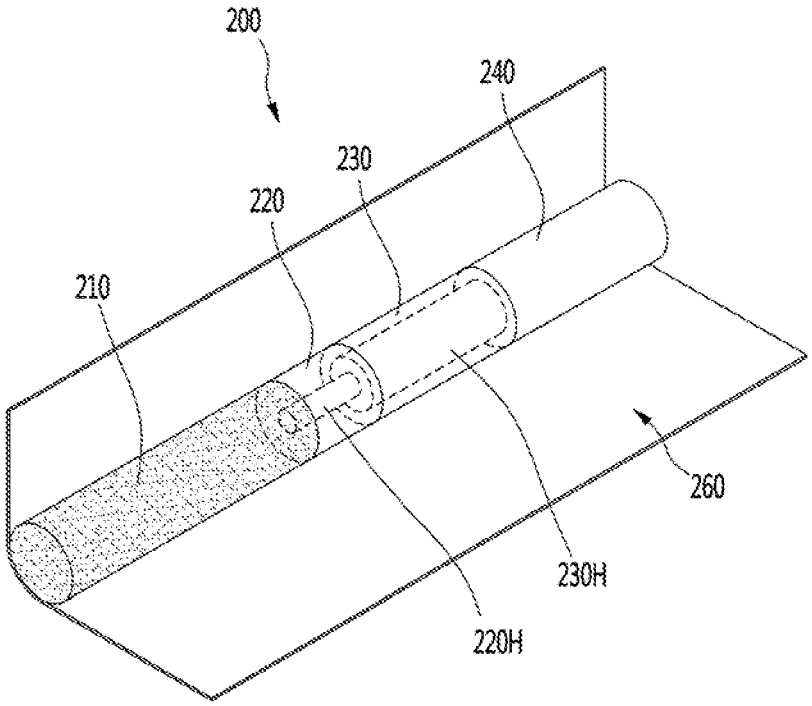
[FIG.6]
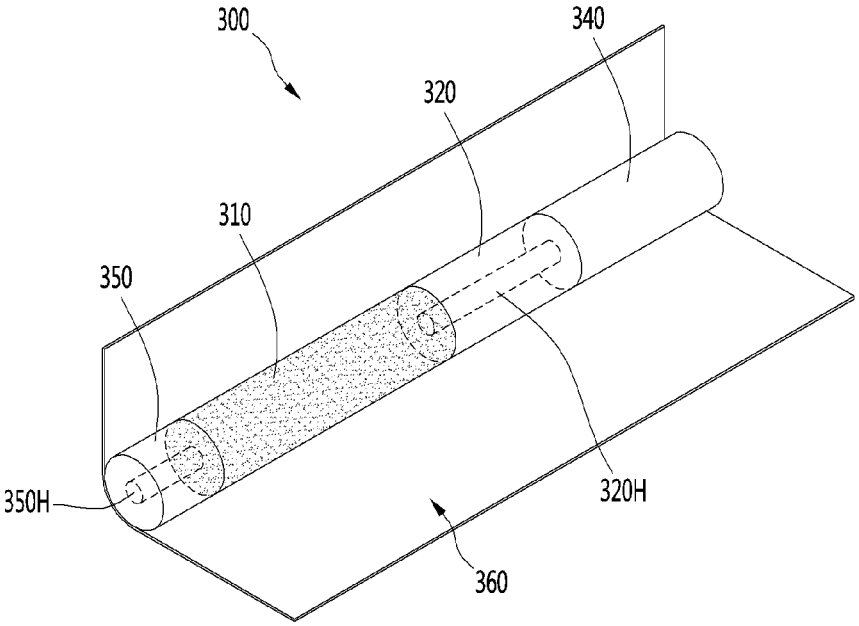

[FIG.7]
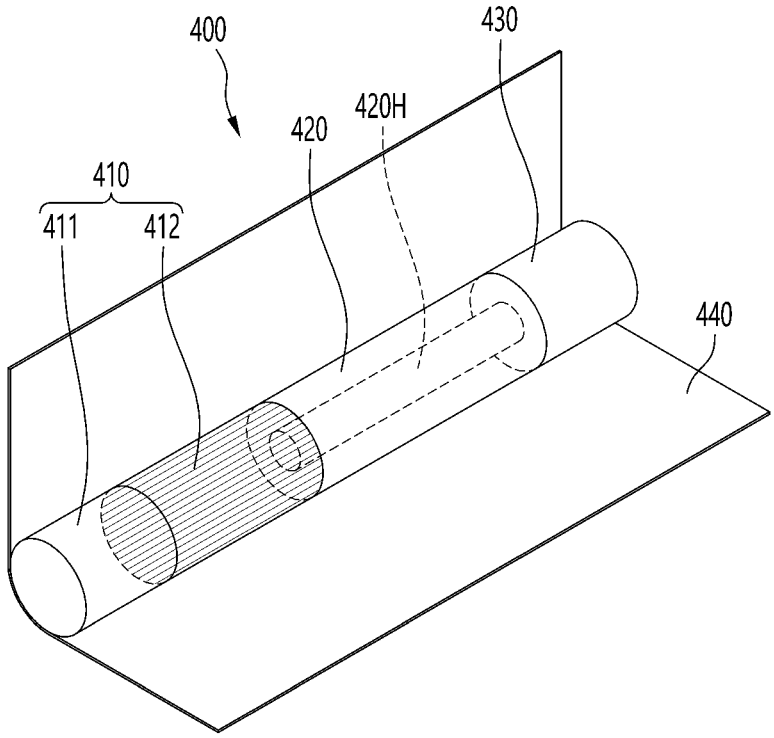
[FIG. 8]
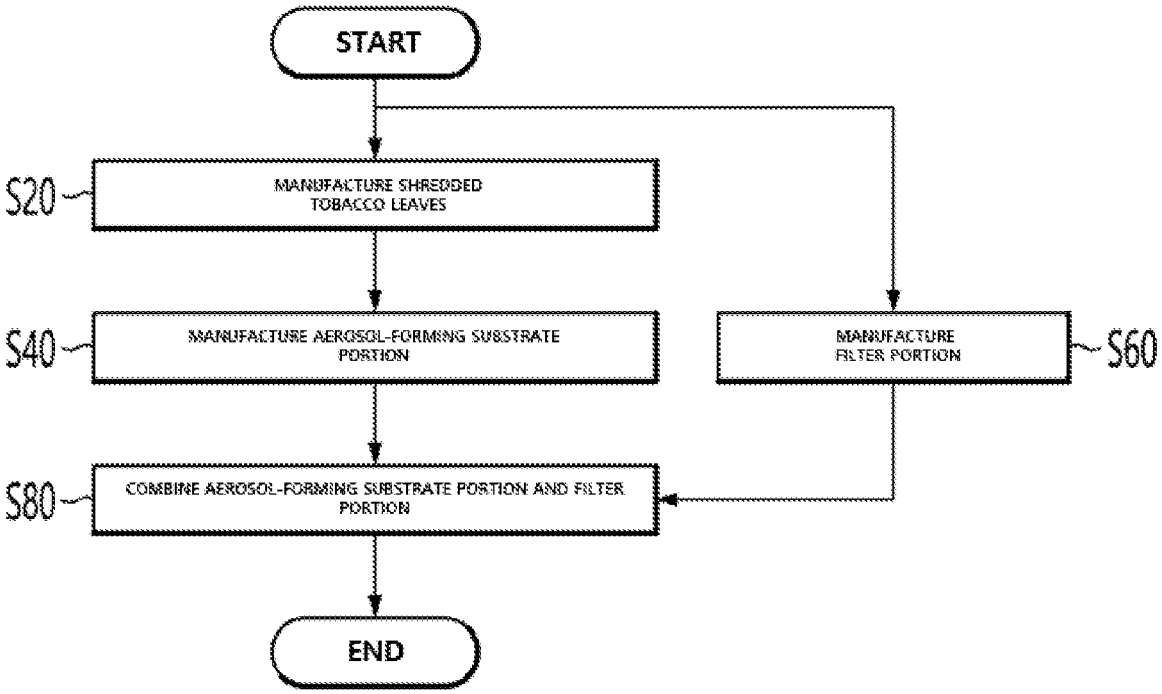

[FIG. 9]
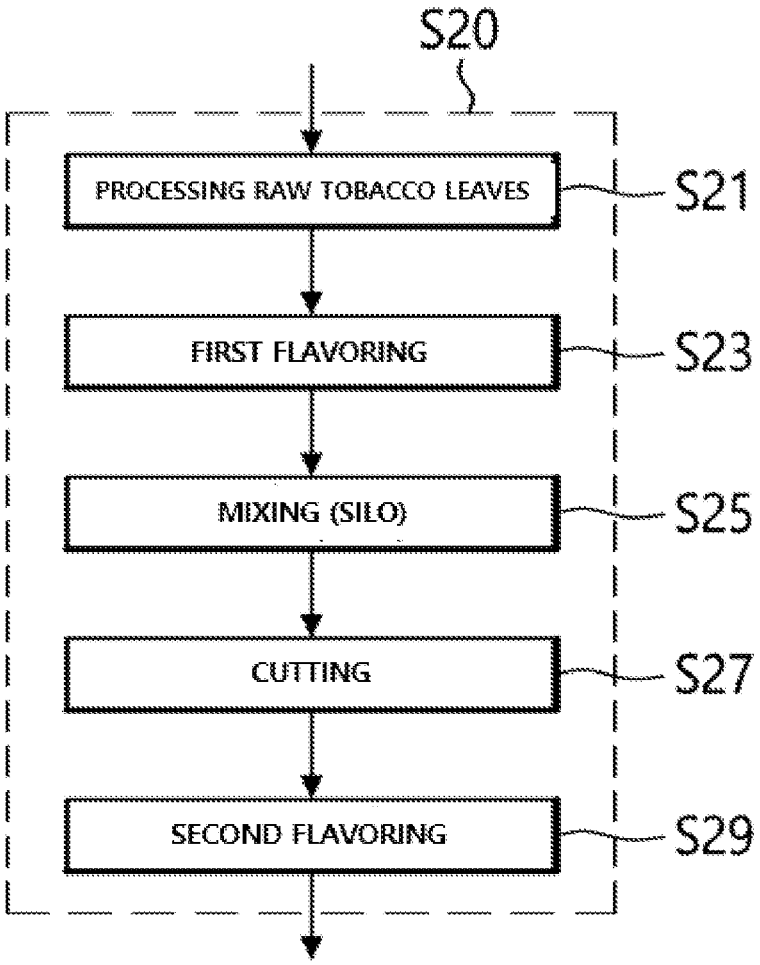

[FIG.10]
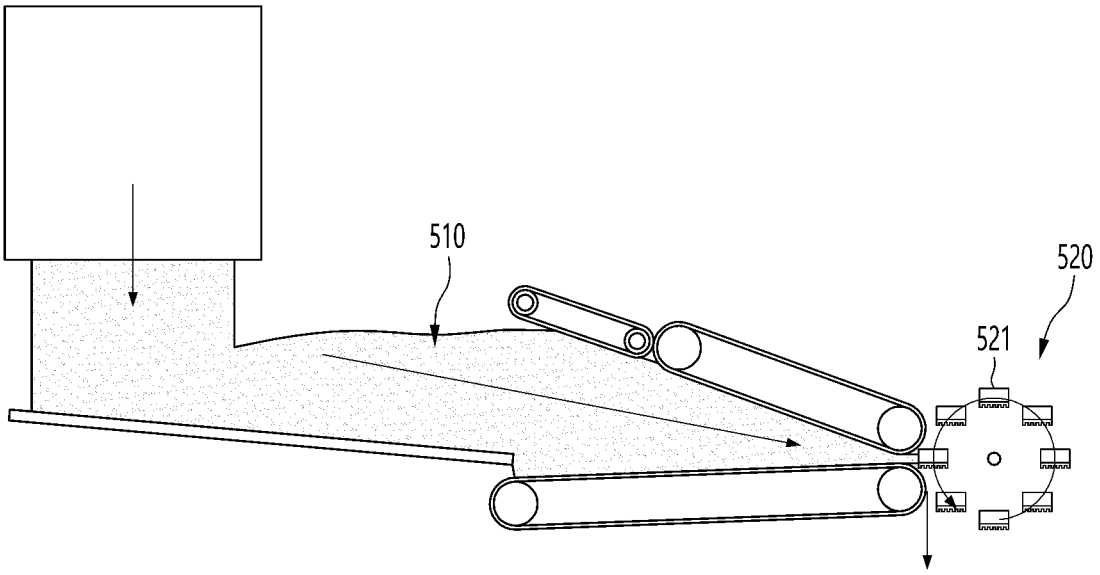
[FIG. 11]
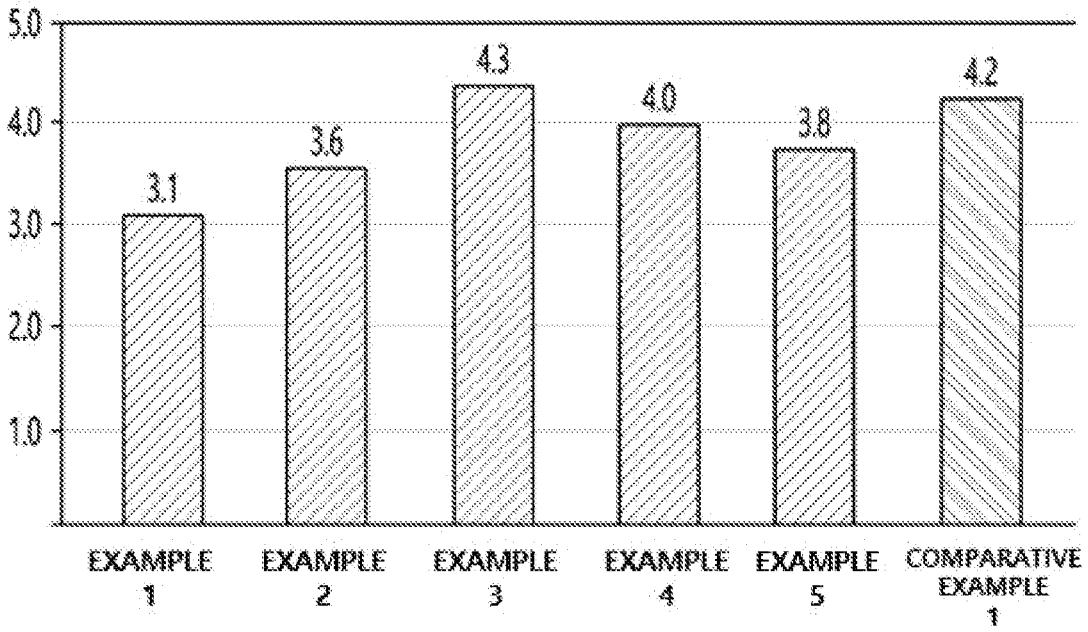

[FIG. 12]
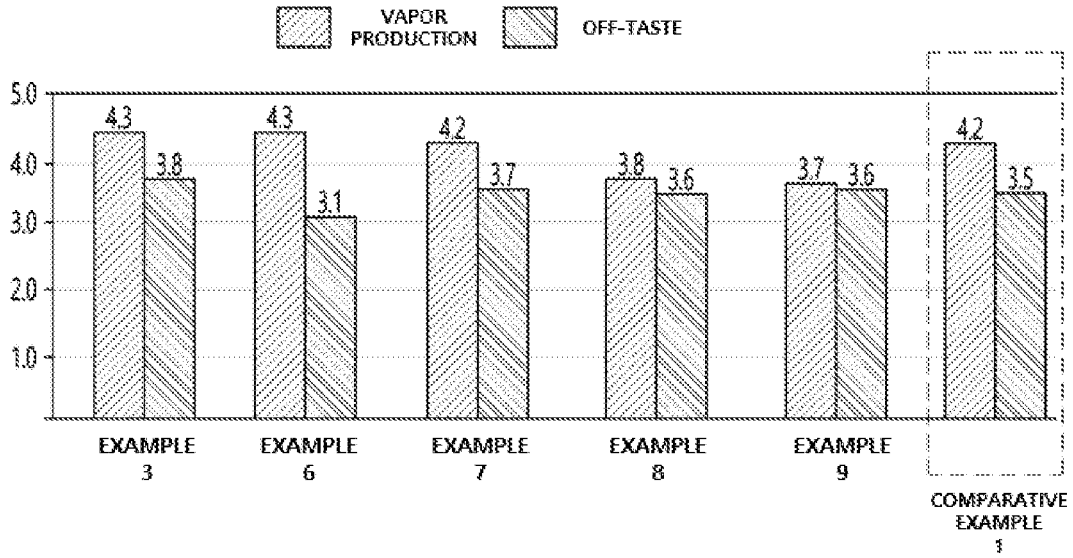
[FIG. 13]
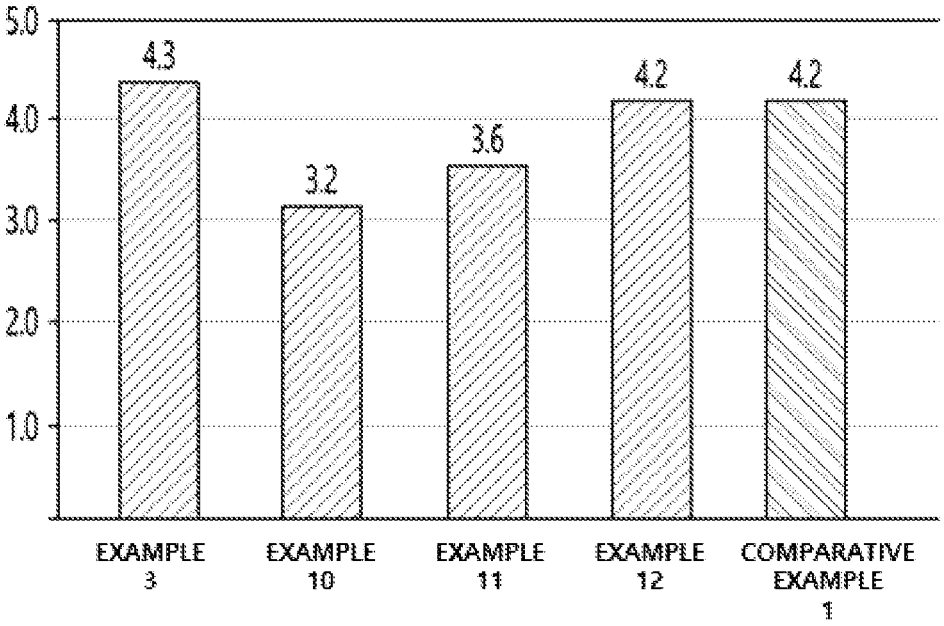

[FIG. 14]
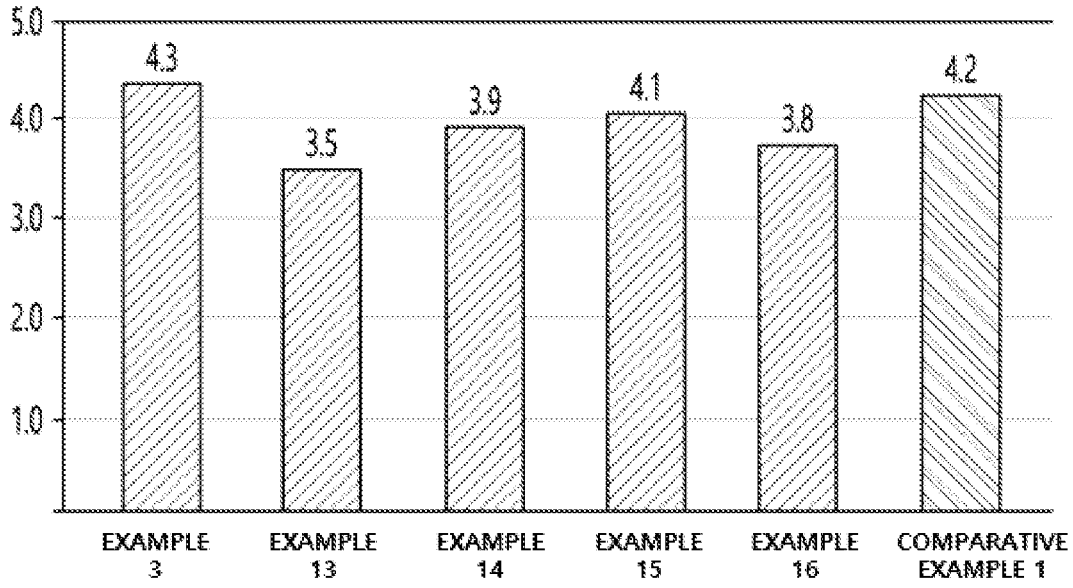
[FIG. 15]
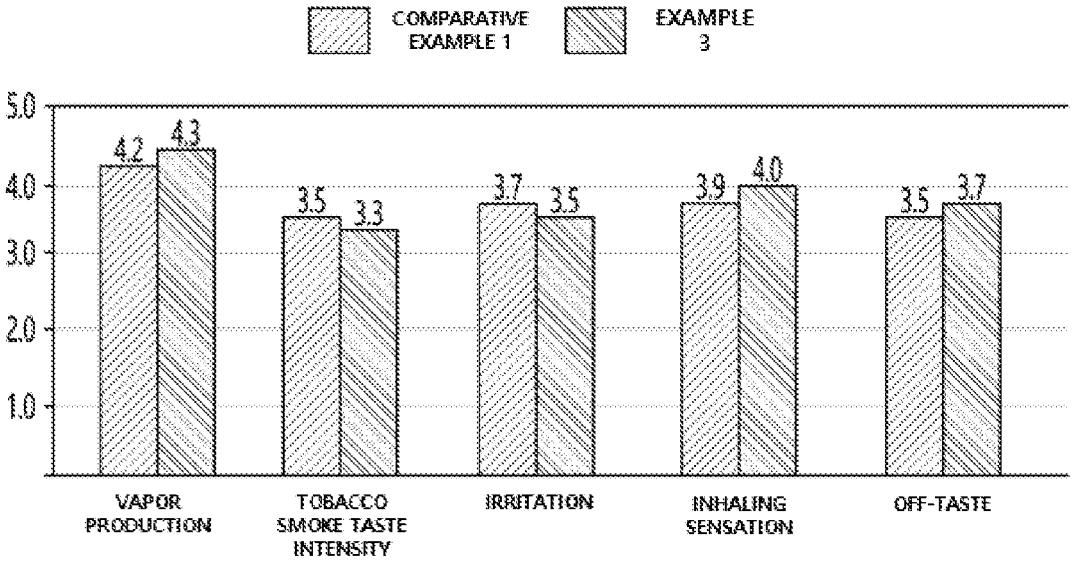

AEROSOL-GENERATING ARTICLE AND METHOD OF MANUFACTURING THE SAME

CROSS REFERENCE TO RELATED APPLICATIONS

This application is a National Stage of International Application No. PCT/KR2021/008975 filed on Jul. 13, 2021, claiming priority based on Korean Patent Application No. 10-2020-0099767 filed on Aug. 10, 2020.

TECHNICAL FIELD

The present disclosure relates to an aerosol-generating article and a method of manufacturing the same, and more particularly, to an aerosol-generating article, which is used together with an aerosol generation device, and a method of manufacturing the same that are capable of simultaneously improving satisfaction with a tobacco smoke taste and allowing the aerosol-generating article to be manufactured at low cost.

BACKGROUND ART

In recent years, demand for alternative articles that overcome the disadvantages of traditional cigarettes has increased. For example, demand for devices and articles that generate an aerosol through heating instead of generating an aerosol through combustion has increased. Accordingly, active research has been carried out on heating-type aerosol-generating articles or heating-type aerosol generation devices.

Most of the heating-type aerosol-generating articles are manufactured based on a reconstituted tobacco sheet (e.g., a sheet made of reconstituted tobacco leaves). However, the high manufacturing costs of the reconstituted tobacco sheet serve as the main cause of an increase in the unit price of the aerosol-generating article. Further, during manufacture of the reconstituted tobacco sheet, supplementary materials such as pulp and guar gum are essentially added, and such supplementary materials may reduce the inherent taste of tobacco and cause an off-taste and thus deteriorate a user's satisfaction with a tobacco smoke taste.

DISCLOSURE

Technical Problem

Some embodiments of the present disclosure are directed to providing an aerosol-generating article and a method of manufacturing the same capable of simultaneously improving satisfaction with a tobacco smoke taste and allowing the aerosol-generating article to be manufactured at low cost.

Objectives of the present disclosure are not limited to the above-mentioned objectives, and other unmentioned objectives should be clearly understood by those of ordinary skill in the art to which the present disclosure pertains from the description below.

Technical Solution

An aerosol-generating article according to some embodiments of the present disclosure, which is an article inserted into an aerosol generation device to generate an aerosol, includes an aerosol-forming substrate portion which includes shredded tobacco leaves and is configured to form an aerosol when electrically heated by the aerosol generation device and a mouthpiece portion which is disposed downstream of the aerosol-forming substrate portion to form a downstream end of the aerosol-generating article.

In some embodiments, the aerosol-forming substrate portion may not include a tobacco material other than the shredded tobacco leaves.

In some embodiments, a cutting width of the shredded tobacco leaves may be in a range of 1.0 mm to 1.4 mm.

In some embodiments, the shredded tobacco leaves content included in the aerosol-forming substrate portion may be in a range of 150 mg to 200 mg.

In some embodiments, the shredded tobacco leaves may be manufactured through a manufacturing process including a flavoring process, a moisturizer may be added during the flavoring process, and a weight ratio between glycerin and propylene glycol included in the moisturizer may be in a range of 1:1 to 8:2.

In some embodiments, the moisture content in the shredded tobacco leaves may be in a range of 12% to 17% of the total weight of the shredded tobacco leaves.

In some embodiments, a resistance to draw of the mouthpiece portion may be in a range of 90 mm WG to 140 mm WG.

A method of manufacturing an aerosol-generating article according to some embodiments of the present disclosure, which is a method of manufacturing an article inserted into an aerosol generation device to generate an aerosol, includes processing raw tobacco leaves to manufacture shredded tobacco leaves, using the manufactured shredded tobacco leaves to form an aerosol-forming substrate portion, and combining the formed aerosol-forming substrate portion and a mouthpiece portion.

Advantageous Effects

According to various embodiments of the present disclosure, an electric heating-type aerosol-generating article can be manufactured by utilizing shredded tobacco leaves instead of a reconstituted tobacco sheet. Since a manufacturing cost of the shredded tobacco leaves is much cheaper than a manufacturing cost of the reconstituted tobacco sheet, the price competitiveness of the aerosol-generating article can be significantly improved.

Also, by utilizing the shredded tobacco leaves instead of the reconstituted tobacco sheet, an off-taste can be reduced and the original taste of the tobacco leaves can be delivered to a user during smoking. Accordingly, the user's satisfaction with a tobacco smoke taste can be significantly improved.

Also, during manufacture of the shredded tobacco leaves, since raw tobacco leaves are cut at a suitable cutting width (e.g., about 1.2 mm), a phenomenon in which the shredded tobacco leaves stick out from an end can be reduced during manufacture of the aerosol-generating article (that is, workability can be improved), and vapor production can be enhanced.

Also, by adding a suitable amount of the shredded tobacco leaves (e.g., about 170 mg), the phenomenon in which the shredded tobacco leaves stick out from an end can be reduced during manufacture of the aerosol-generating article, and the price competitiveness and tobacco taste of the aerosol-generating article can be improved.

Also, during manufacture of the shredded tobacco leaves, by adding glycerin and propylene glycol at a suitable ratio (e.g., about 7:3), vapor production of the aerosol-generating article can be enhanced.

Also, during manufacture of the shredded tobacco leaves, by suitably controlling the moisture content in the shredded tobacco leaves (e.g., to about 14.5% of the total weight of the shredded tobacco leaves), vapor production of the aerosol-generating article can be enhanced, and workability of manufacturing the aerosol-generating article can be improved.

Also, by adding a suitable amount of the moisturizer (e.g., about 3% of the total weight of the shredded tobacco) during a second flavoring process of a process of manufacturing the shredded tobacco leaves, the vapor production of the aerosol-generating article can be further enhanced, and an off-taste can be reduced.

The advantageous effects according to the technical spirit of the present disclosure are not limited to the above-mentioned advantageous effects, and other unmentioned advantageous effects should be clearly understood by those of ordinary skill in the art from the description below.

DESCRIPTION OF DRAWINGS

FIGS. 1 to 3 illustrate various types of aerosol generation devices to which an aerosol-generating article according to some embodiments of the present disclosure is applicable.

FIG. 4 is an exemplary configuration diagram schematically illustrating an aerosol-generating article according to a first embodiment of the present disclosure.

FIG. 5 is an exemplary configuration diagram schematically illustrating an aerosol-generating article according to a second embodiment of the present disclosure.

FIG. 6 is an exemplary configuration diagram schematically illustrating an aerosol-generating article according to a third embodiment of the present disclosure.

FIG. 7 is an exemplary configuration diagram schematically illustrating an aerosol-generating article according to a fourth embodiment of the present disclosure.

FIGS. 8 and 9 are exemplary flowcharts illustrating a method of manufacturing an aerosol-generating article according to some embodiments of the present disclosure.

FIG. 10 is an exemplary view for additionally describing cutting step S27 of FIG. 9.

FIG. 11 illustrates a result of sensory evaluation of changes in vapor production according to a cutting width of shredded tobacco leaves.

FIG. 12 illustrates a result of sensory evaluation of changes in a tobacco taste and vapor production according to the shredded tobacco leaves content.

FIG. 13 illustrates a result of sensory evaluation of changes in vapor production according to a ratio between glycerin and propylene glycol.

FIG. 14 illustrates a result of sensory evaluation of changes in vapor production according to the moisture content in the shredded tobacco leaves.

FIG. 15 illustrates a comprehensive result of sensory evaluation of aerosol-generating articles according to examples.

MODES OF THE INVENTION

Hereinafter, exemplary embodiments of the present disclosure will be described in detail with reference to the accompanying drawings. Advantages and features of the present disclosure and methods of achieving the same should become clear with embodiments described in detail below with reference to the accompanying drawings. However, the technical spirit of the present disclosure is not limited to the following embodiments and may be implemented in various different forms. The embodiments make the technical spirit of the present disclosure complete and are provided to completely inform those of ordinary skill in the art to which the present disclosure pertains of the scope of the present disclosure. The technical spirit of the present disclosure is defined only by the scope of the claims.

In assigning reference numerals to components of each drawing, it should be noted that the same reference numerals are assigned to the same components as much as possible even when the components are illustrated in different drawings. Also, in describing the present disclosure, when detailed description of a known related configuration or function is deemed as having the possibility of obscuring the gist of the present disclosure, the detailed description thereof will be omitted.

Unless otherwise defined, all terms including technical or scientific terms used herein have the same meaning as commonly understood by those of ordinary skill in the art to which the present disclosure pertains. Terms defined in commonly used dictionaries should not be construed in an idealized or overly formal sense unless expressly so defined herein. Terms used herein are for describing the embodiments and are not intended to limit the present disclosure. In the following embodiments, a singular expression includes a plural expression unless the context clearly indicates otherwise.

Also, in describing components of the present disclosure, terms such as first, second, A, B, (a), and (b) may be used. Such terms are only used for distinguishing one component from another component, and the essence, order, sequence, or the like of the corresponding component is not limited by the terms. In a case in which a certain component is described as being "connected," "coupled," or "linked" to another component, it should be understood that, although the component may be directly connected or linked to the other component, still another component may also be "connected," "coupled," or "linked" between the two components.

The terms "comprises" and/or "comprising" used herein do not preclude the presence or addition of one or more components, steps, operations, and/or devices other than those mentioned.

First, some terms used in the following embodiments will be clarified.

In the following embodiments, "aerosol-forming substrate" may refer to a material capable of forming an aerosol. The aerosol may include a volatile compound. The aerosol-forming substrate may be a solid or liquid.

For example, a solid aerosol-forming substrate may include a solid material based on tobacco raw materials, such as shredded tobacco leaves and reconstituted tobacco (e.g., reconstituted tobacco leaves), and a liquid aerosol-forming substrate may include a liquid composition based on tobacco materials, tobacco extracts, and/or various flavoring agents. However, the scope of the present disclosure is not limited to the above-listed examples.

As a more specific example, the liquid aerosol-forming substrate may include at least one of propylene glycol (PG) and glycerin (GLY) and may further include at least one of ethylene glycol, dipropylene glycol, diethylene glycol, triethylene glycol, tetraethylene glycol, and oleyl alcohol. As another example, the aerosol-forming substrate may further include at least one of a tobacco material, moisture, and a flavoring material. As still another example, the aerosol-forming substrate may further include various additives such as cinnamon and capsaicin. The aerosol-forming substrate may not only include a liquid material with high fluidity but also include a material in the form of a gel or solid. In this way, as the components constituting the aerosol-forming substrate, various materials may be selected according to embodiments, and composition ratios thereof may also vary according to embodiments. In the following description, "liquid" may be understood as referring to the liquid aerosol-forming substrate.

In the following embodiments, "aerosol generation device" may refer to a device that generates an aerosol using an aerosol-forming substrate in order to generate an aerosol that can be inhaled directly into the user's lungs through the user's mouth. Some examples of the aerosol generation device will be described below with reference to FIGS. 1 to 3. However, the examples of the aerosol generation device may further include various other kinds of aerosol generation devices, and the scope of the present disclosure is not limited to the devices according to FIGS. 1 to 3.

In the following embodiments, "aerosol-generating article" may refer to an article capable of generating an aerosol. The aerosol-generating article may include an aerosol-forming substrate. For example, the aerosol-generating article may be a cigarette, but the scope of the present disclosure is not limited to such an example.

In the following embodiments, "puff" refers to inhalation by a user, and the inhalation may refer to a situation in which a user draws smoke into his or her oral cavity, nasal cavity, or lungs through the mouth or nose.

In the following embodiments, "upstream" or "upstream direction" may refer to a direction moving away from an oral region of a user, and "downstream" or "downstream direction" may refer to a direction approaching the oral region of the user. The terms "upstream" and "downstream" may be used to describe relative positions of components constituting a smoking article. For example, in an aerosol-generating article 100 illustrated in FIG. 4, a filter portion 120 is disposed downstream or in a downstream direction of an aerosol-forming substrate portion 110, and the aerosol-forming substrate portion 110 is disposed upstream or in an upstream direction of the filter portion 120.

In the following embodiments, "length direction" refers to a longitudinal direction of an aerosol-generating article, and "diameter direction" refers to a transverse direction of the aerosol-generating article. That is, "diameter direction" refers to a direction perpendicular to "length direction."

Hereinafter, various embodiments of the present disclosure will be described in detail with reference to the accompanying drawings.

FIGS. 1 to 3 illustrate various types of aerosol generation devices 1000 to which an aerosol-generating article 2000 according to some embodiments of the present disclosure is applicable. In particular, FIGS. 1 to 3 illustrate a state in which the aerosol-generating article 2000 is inserted into the aerosol generation device 1000.

As illustrated in FIG. 1, the aerosol generation device 1000 may include a battery 1100, a controller 1200, and a heater 1300. In some embodiments, as illustrated in FIGS. 2 and 3, the aerosol generation device 1000 may further include a vaporizer 1400. Also, the aerosol-generating article 2000 may be inserted into a space inside the aerosol generation device 1000. However, in the aerosol generation devices 1000 illustrated in FIGS. 1 to 3, only the components relating to the present embodiment are illustrated. Therefore, those of ordinary skill in the art relating to the present embodiment should understand that the aerosol generation devices 1000 may further include general-purpose components other than the components illustrated in FIGS. 1 to 3.

In FIG. 1, the battery 1100, the controller 1200, and the heater 1300 are illustrated as being arranged in a row. Also, in FIG. 2, the battery 1100, the controller 1200, the vaporizer 1400, and the heater 1300 are illustrated as being arranged in a row. In addition, in FIG. 3, the vaporizer 1400 and the heater 1300 are illustrated as being arranged in parallel. However, an internal structure of the aerosol generation device 1000 is not limited to those illustrated in FIGS. 1 to 3. In other words, the arrangement of the battery 1100, the controller 1200, the heater 1300, and the vaporizer 1400 may be changed according to the design of the aerosol generation device 1000.

When the aerosol-generating article 2000 is inserted into the aerosol generation device 1000, the aerosol generation device 1000 may operate the heater 1300 and/or vaporizer 1400 to generate an aerosol. For example, the aerosol-generating article 2000 may generate an aerosol when heated by the heater 1300. The aerosol generated due to the heater 1300 and/or vaporizer 1400 may pass through the aerosol-generating article 2000 and be inhaled through an oral region of a user.

The battery 1100 may supply power used to operate the aerosol generation device 1000. For example, the battery 1100 may supply power to allow the heater 1300 or vaporizer 1400 to be heated and supply power required for operation of the controller 1200. Also, the battery 1100 may supply power required for operation of a display, a sensor, a motor, and the like installed in the aerosol generation device 1000.

Next, the controller 1200 may control the overall operation of the aerosol generation device 1000. Specifically, the controller 1200 may not only control operation of the battery 1100, the heater 1300, and the vaporizer 1400 but also control operation of other components included in the aerosol generation device 1000. Also, the controller 1200 may check the state of each component of the aerosol generation device 1000 and determine whether the aerosol generation device 1000 is in an operable state.

The controller 1200 may include at least one processor. The processor may be implemented with an array of a plurality of logic gates or implemented with a combination of a general-purpose microprocessor and a memory which stores a program that may be executed by the microprocessor. Also, those of ordinary skill in the art to which the present embodiment pertains should understand that the controller 1200 may also be implemented with other forms of hardware.

In some embodiments, the controller 1200 may recognize the type of substrate of the aerosol-generating article 2000. Specifically, the controller 1200 may recognize whether an aerosol-forming substrate included in the aerosol-generating article 2000 is a reconstituted sheet type or a shredded tobacco leaf type. For example, the controller 1200 may recognize the substrate type through an identification element attached to the aerosol-generating article 2000 (e.g., an aluminum foil attached to an upstream end of the aerosol-generating article 2000) or may recognize the substrate type on the basis of a user's input (e.g., button selection). However, the scope of the present disclosure is not limited to such examples. The controller 1200 may control the heater 1300 on the basis of the result of recognition. Specifically, in a case in which the substrate type is the reconstituted sheet type, the controller 1200 may operate the heater 1300 on the basis of a first temperature profile that is suitable for a reconstituted sheet, and in a case in which the substrate type is the shredded tobacco leaf type, the controller 1200 may operate the heater 1300 on the basis of a second temperature profile that is suitable for shredded tobacco leaves. In this way, an optimal tobacco smoke taste may be delivered to the user according to the substrate type of the aerosol-generating article 2000.

Next, the heater 1300 may be heated by power supplied from the battery 1100. For example, when the aerosol-generating article 2000 is inserted into the aerosol generation device 1000, the aerosol generation device 1000 may operate the heater 1300 to heat the aerosol-generating article 2000. The heater 1300 may be disposed inside or outside the aerosol-generating article. Therefore, the heated heater 1300 may increase the temperature of the aerosol-forming substrate in the aerosol-generating article 2000.

The heater 1300 may be an electrically resistive heater. For example, an electrically conductive track may be included in the heater 1300, and the heater 1300 may be heated as current flows in the electrically conductive track. However, the heater 1300 is not limited to the above-described example, and any other heater may be used without limitation as long as the heater can be heated to a target temperature. Here, the target temperature may be preset in the aerosol generation device 1000 (e.g., temperature profiles may be pre-stored therein) or may be set to a desired temperature by the user.

Meanwhile, as another example, the heater 1300 may be an induction heating type heater. Specifically, the heater 1300 may include an electrically conductive coil for heating the aerosol-generating article 2000 using an induction heating method, and the aerosol-generating article 2000 may include a susceptor material that can be heated by the induction heating type heater. Alternatively, the heater 1300 may be made of an assembly including an electrically conductive coil and a susceptor, and the susceptor of the heater 1300 may heat the aerosol-generating article 2000 using an induction heating method.

For example, the heater 1300 may include a tubular heating element, a plate-shaped heating element, a needle-shaped heating element, or a rod-shaped heating element and may heat the inside or outside of the aerosol-generating article 2000 according to the shape of the heating element.

Also, a plurality of heaters 1300 may be disposed in the aerosol generation device 1000. Here, the plurality of heaters 1300 may be disposed to be inserted into the aerosol-generating article 2000 or may be disposed outside the aerosol-generating article 2000. Also, some of the plurality of heaters 1300 may be disposed to be inserted into the aerosol-generating article 2000 while the rest of the heaters 1300 are disposed outside the aerosol-generating article 2000. Also, the shape of the heater 1300 is not limited to the shapes illustrated in FIGS. 1 to 3, and the heater 1300 may be manufactured in various other shapes.

Next, the vaporizer 1400 may heat the liquid composition (that is, the liquid aerosol-forming substrate) to generate an aerosol, and the generated aerosol may pass through the aerosol-generating article 2000 and be delivered to the user. For example, the aerosol generated due to the vaporizer 1400 may move along an air flow path of the aerosol generation device 1000, and the air flow path may be configured to allow the aerosol generated due to the vaporizer 1400 to pass through the aerosol-generating article 2000 and be delivered to the user.

The vaporizer 1400 according to some embodiments may include a liquid reservoir, a liquid delivering element, and a heating element. However, the vaporizer 1400 is not limited thereto. The liquid reservoir, liquid delivering element, and heating element may also be included as independent modules in the aerosol generation device 1000. Hereinafter, the components of the vaporizer 1400 will be briefly described.

The liquid reservoir may store a liquid composition. For example, the liquid composition may be a liquid including a tobacco-containing material such as a volatile tobacco flavor component or may be a liquid including a non-tobacco material. The liquid reservoir may be manufactured to be attachable to or detachable from the vaporizer 1400 or may be manufactured to be integrated with the vaporizer 1400.

For example, the liquid composition may include water, a solvent, ethanol, a plant extract, a flavoring, a flavoring agent, or a vitamin mixture. The flavoring may include menthol, peppermint, spearmint oil, or various fruit flavor components, but is not limited thereto. The flavoring agent may include components that can provide various flavors or tastes to the user. The vitamin mixture may be a mixture of one or more of vitamin A, vitamin B, vitamin C, and vitamin E, but is not limited thereto. Also, the liquid composition may include an aerosol former such as glycerine and propylene glycol.

Next, the liquid delivering element may deliver the liquid composition of the liquid reservoir to the heating element. For example, the liquid delivering element may be a wick such as a porous structure in which cotton fiber, ceramic fiber, glass fiber, a porous ceramic, and a plurality of beads are gathered, but is not limited thereto.

Next, the heating element is an element for heating the liquid composition delivered by the liquid delivering element. For example, the heating element may be a metal heat wire, a metal heat plate, a ceramic heater, or the like, but is not limited thereto. Also, the heating element may be made of a conductive filament such as a nichrome wire and may be disposed to be wound around the liquid delivering element.

The heating element may be heated by current supplied thereto and may deliver heat to the liquid composition, which is in contact with the heating element, to heat the liquid composition. As a result, an aerosol may be generated.

For reference, the vaporizer 1400 may also be referred to as a cartomizer, an atomizer, or a cartridge in the art.

As mentioned above, the aerosol generation device 1000 may further include general-purpose components other than the battery 1100, the controller 1200, the heater 1300, and the vaporizer 1400. For example, the aerosol generation device 1000 may include a display that can output visual information and/or a motor for output of tactile information. Also, the aerosol generation device 1000 may include at least one sensor. Also, the aerosol generation device 1000 may be manufactured to have a structure that allows entry of outside air or leakage of a gas therein even in a state in which the aerosol-generating article 2000 is inserted into the aerosol generation device 1000.

Although not illustrated in FIGS. 1 to 3, the aerosol generation device 1000 may also constitute a system together with a separate cradle. For example, the cradle may be used in charging the battery 1100 of the aerosol generation device 1000. Alternatively, the heater 1300 may be heated in a state in which the cradle and the aerosol generation device 1000 are coupled.

Next, the aerosol-generating article 2000 may be inserted into the aerosol generation device 1000 and generate an aerosol when electrically heated. Here, the aerosol may be generated in the aerosol-generating article 2000 as outside air enters the aerosol generation device 1000, and the generated aerosol may be inhaled by the user through the oral region of the user.

Ways in which outside air enters the aerosol generation device 1000 may vary according to an embodiment. For example, outside air may enter the aerosol generation device 1000 through at least one air path formed in the aerosol generation device 1000. Here, the opening or closing of the air path formed in the aerosol generation device 1000 and/or the size of the air path may be controlled by the user. In such a case, vapor production, tobacco smoke taste, and the like may be controlled by the user. As another example, outside air may enter the aerosol-generating article 2000 through at least one hole formed in a surface of the aerosol-generating article 2000.

The aerosol-generating article 2000 may include a substrate that can form an aerosol, and the aerosol-forming substrate may include a tobacco material.

In some embodiments, the tobacco material may include shredded tobacco leaves. For example, the tobacco material may not include materials other than the shredded tobacco leaves. As another example, the tobacco material may include both the shredded tobacco leaves and a reconstituted tobacco sheet. Since a manufacturing cost of the shredded tobacco leaves is much cheaper than a manufacturing cost of other tobacco materials (e.g., the reconstituted tobacco sheet), according to the present embodiment, the unit price of the aerosol-generating article 2000 may be significantly reduced. The present embodiment and a detailed structure of the aerosol-generating article 2000 will be described in more detail below with reference to FIG. 4 and so on.

Various types of aerosol generation devices 1000 to which the aerosol-generating article 2000 according to some embodiments of the present disclosure is applicable have been described above with reference to FIGS. 1 to 3. Hereinafter, the aerosol-generating article 2000 which is applicable to the device 1000 will be described.

FIGS. 4 to 7 illustrate various structures of an aerosol-generating article. As illustrated in FIGS. 4 to 7, a detailed structure of an aerosol-generating article may vary by type. Hereinafter, for convenience of understanding and clarity of the specification, each type of aerosol-generating article will be described using different reference numerals.

FIG. 4 is an exemplary configuration diagram schematically illustrating an aerosol-generating article 100 according to a first embodiment of the present disclosure.

As illustrated in FIG. 4, the aerosol-generating article 100 may include an aerosol-forming substrate portion 110, a filter portion 120, and a wrapper 130. Only the components relating to the embodiment of the present disclosure are illustrated in FIG. 4. Therefore, those of ordinary skill in the art to which the present disclosure pertains should understand that the aerosol-generating article 100 may further include general-purpose components other than the components illustrated in FIG. 4. Hereinafter, each component of the aerosol-generating article 100 will be described.

The aerosol-forming substrate portion 110 may include an aerosol-forming substrate and may be disposed upstream of the filter portion 120. The aerosol-forming substrate portion 110 may further include a wrapper that wraps around the aerosol-forming substrate. The aerosol-forming substrate portion 110 and the filter portion 120 may be wrapped by the wrapper 130. Although not clearly illustrated, the aerosol-forming substrate portion 110 and the filter portion 120 may be connected by a tipping wrapper. However, the scope of the present disclosure is not limited thereto.

The aerosol-forming substrate may include a tobacco material. Also, the aerosol-forming substrate may further include materials other than the tobacco material. For example, the aerosol-forming substrate may further include at least one of glycerin, propylene glycol, ethylene glycol, dipropylene glycol, diethylene glycol, triethylene glycol, tetraethylene glycol, and oleyl alcohol, but is not limited thereto. Also, the aerosol-forming substrate may contain other additives such as a flavoring agent, a wetting agent, and/or organic acid. Also, a flavoring liquid such as menthol or a moisturizer may be added to the aerosol-forming substrate.

In some embodiments, the tobacco material may be shredded tobacco leaves. For example, the aerosol-forming substrate may not include tobacco materials other than the shredded tobacco leaves. In this case, material costs can be significantly reduced as compared to a case in which a reconstituted tobacco sheet (e.g., a reconstituted tobacco slurry) is utilized, and an off-taste can also be reduced. Specifically, the reconstituted tobacco sheet such as a reconstituted tobacco slurry requires a higher manufacturing cost as compared to the shredded tobacco leaves, and due to having inferior filling power as compared to the shredded tobacco leaves, the reconstituted tobacco sheet is inevitably filled at a larger amount as compared to the shredded tobacco leaves. Further, since supplementary materials such as pulp and guar gum are essentially added during manufacture of the reconstituted tobacco sheet, an off-taste may be generated and an inherent taste of tobacco leaves may not be delivered to the user during smoking. Therefore, in a case in which the reconstituted tobacco sheet is replaced with the shredded tobacco leaves, both the material costs and off-taste can be reduced.

Also, in some embodiments, the tobacco material may be a mixture in which shredded tobacco leaves and a reconstituted tobacco sheet (e.g., a reconstituted tobacco slurry or shredded tobacco thereof) are mixed at a suitable ratio. For example, the tobacco material may be a mixture in which the shredded tobacco leaves and reconstituted tobacco sheet are mixed at a weight ratio in a range of about 6:4 to 9:1. Preferably, the weight ratio may be in a range of about 7:3 to 9:1 or about 8:3 to 9:1. More preferably, the weight ratio may be about 8:2.

In the previous embodiments, the cutting width of shredded tobacco leaves, the shredded tobacco leaves content in the tobacco material, the moisture content in shredded tobacco leaves, and the like are closely related to the vapor production, manufacture workability, unit price, and the like of the aerosol-generating article 100 and thus, preferably, may be set to suitable values.

In some embodiments, the cutting width of the shredded tobacco leaves may be in a range of about 1.0 mm to 1.5 mm. Here, the cutting width may refer to a width at which raw tobacco leaves are cut to manufacture shredded tobacco leaves. Preferably, the cutting width may be in a range of about 1.0 mm to 1.4 mm or 1.1 mm to 1.5 mm. More preferably, the cutting width may be in a range of about 1.1 mm to 1.3 mm or may be about 1.2 mm. Within such numerical ranges, a smooth air flow path may be secured to enhance vapor production (i.e., amount of generated aerosol), and a phenomenon in which shredded tobacco leaves stick out (so-called "sticking-out phenomenon") may also be reduced during the manufacturing process. Otherwise, in a case in which the cutting width is set to be too small (e.g., 0.7 mm, 0.9 mm, or the like), vapor production may be significantly reduced due to a decrease in the number of pores in the aerosol-forming substrate portion 110, and the sticking-out phenomenon may frequently occur during the article manufacturing process due to the shredded tobacco leaves being too thin. Also, in a case in which the cutting width is set to be too large (e.g., 1.5 mm or more), since the tobacco leaves are not cut at a uniform width, vapor production may be reduced or become non-uniform. Refer to Experimental Examples 1-1 and 1-2 for further details of the present embodiment.

Also, in some embodiments, the shredded tobacco leaves content may be in a range of about 140 mg to 210 mg. Preferably, the content may be in a range of about 150 mg to 200 mg or 150 mg to 190 mg. More preferably, the content may be in a range of about 160 mg to 180 mg or 165 mg to 175 mg or may be about 170 mg. Within such numerical ranges, a smooth air flow path and a tobacco taste may be secured, and the cost reduction effect may also be maximized. Further, the sticking-out phenomenon may also be reduced during the manufacturing process, and thus workability may be significantly improved. Otherwise, in a case in which the content of shredded tobacco leaves is too high, the cost reduction effect may be degraded or an air flow path may be blocked such that vapor production is reduced. Also, the wrapper may be damaged by an excessive amount of shredded tobacco leaves added to the aerosol-forming substrate portion 110. Conversely, in a case in which the shredded tobacco leaves content is too low, a tobacco taste may be insufficient, or the inside of the aerosol-forming substrate portion 110 may become loose, causing the sticking-out phenomenon to frequently occur. Refer to Experimental Examples 2-1 and 2-2 for further details of the present embodiment.

Also, in some embodiments, the shredded tobacco leaves may be manufactured through a shredded tobacco manufacturing process including a flavoring process, and a moisturizer may be added during the flavoring process. The moisturizer content in an additive may be, preferably, in a range of about 9% (wt %) to 12% or may be, more preferably, about 10%. Also, a weight ratio of glycerin to propylene glycol which are included in the moisturizer may be, preferably, in a range of about 1:1 to 8:2. More preferably, the weight ratio may be in a range of about 3:2 to 8:2 or 2:1 to 8:2, and even more preferably, the weight ratio may be in a range of about 2:1 to 8:3 or may be about 7:3. Within such numerical ranges, vapor production was confirmed to be enhanced. Refer to Experimental Example 3 for further details.

Also, in some embodiments, the shredded tobacco leaves may be manufactured through a shredded tobacco manufacturing process including a first flavoring process and a second flavoring process (e.g., refer to FIG. 9), and a moisturizer may be added during the second flavoring process. For example, the moisturizer may be glycerin, but the scope of the present disclosure is not limited thereto. Also, the amount of added moisturizer may be in a range of about 1 wt % to 5 wt % of the total weight of the cut tobacco leaves (that is, shredded tobacco leaves) (e.g., about 1 kg to 5 kg of glycerin may be added per 100 kg of shredded tobacco). Preferably, the added amount may be in a range of about 2 wt % to 4 wt %, and more preferably, the added amount may be about 3 wt %. Within such numerical ranges, vapor production of the aerosol-generating article 100 was confirmed to be further enhanced, and an off-taste was confirmed to be significantly reduced. Refer to Experimental Examples 6-1 and 6-2 for further details.

Also, in some embodiments, the moisture content in the shredded tobacco leaves may be in a range of about 11% (wt %) to 18% of the total weight of the shredded tobacco leaves. Preferably, the moisture content may be in a range of about 12% to 17% or 12% to 16%. More preferably, the moisture content may be in a range of about 13% to 16%, 13% to 15%, or 14% to 14.5% or may be about 14%. Within such numerical ranges, a smooth air flow path may be secured to enhance vapor production, and the sticking-out phenomenon may also be reduced. For example, in a case in which the moisture content in the shredded tobacco leaves is too high, due to a phenomenon in which the shredded tobacco leaves form a mass, an air flow path may be blocked and thus vapor production may be reduced. On the other hand, in a case in which the moisture content in the shredded tobacco leaves is too low, the shredded tobacco leaves may easily scatter without forming a mass and thus the sticking-out phenomenon may frequently occur. For reference, the moisture content in the shredded tobacco leaves may be controlled during the shredded tobacco manufacturing process, and the moisture content in the shredded tobacco right after the second flavoring process may be higher than the moisture content in the shredded tobacco of the aerosol-forming substrate portion 110 by about 0.1% to 1%. This is because moisture of the shredded tobacco leaves may be reduced during an additional process after the second flavoring process, a manufacturing process of the aerosol-generating article 100, or a storage period thereof. Refer to Experimental Example 3 for further details of the present embodiment.

Also, in some embodiments, a weight ratio between glycerin and propylene glycol included in the shredded tobacco leaves may be in a range of about 1:1 to 9:1, and preferably, in a range of about 3:2 to 8:2 or about 3:2 to 7:3. Within such numerical ranges, vapor production was confirmed to be enhanced.

Meanwhile, in some embodiments, an adhesive may be applied on an inner side of a wrapper around the shredded tobacco leaves. Here, the adhesive may refer to any material having an adhesive function. More specifically, the aerosol-forming substrate portion 110 may be formed by cutting an aerosol-forming rod, and an adhesive may be applied on at least a portion of an inner side of a wrapper (i.e., wrapping material) during a process of manufacturing the aerosol-forming rod. For example, the aerosol-forming rod may be manufactured by wrapping shredded tobacco leaves with a wrapping material, and an adhesive may be applied on an inner side of the wrapping material before or after wrapping the shredded tobacco leaves with the wrapping material. The adhesive may prevent the sticking-out phenomenon from occurring at an end (or both ends) of the aerosol-forming substrate portion 110 or the aerosol-forming rod and thus improve workability. Refer to the description of FIG. 8 for further details of the present embodiment.

The above-described shredded tobacco leaves may be manufactured by processing raw tobacco leaves, and the manufacturing method will be described in detail below with reference to FIG. 9. Hereinafter, the description of the components of the aerosol-generating article 100 will be continued.

In some embodiments, the aerosol-forming substrate portion 110 or aerosol-forming substrate may be surrounded by a heat conducting material. For example, a heat conducting material may be disposed at an inner side of a wrapper of the aerosol-forming substrate portion 110. The heat conducting material may be a metal foil such as an aluminum foil, but is not limited thereto. The heat conducting material may evenly distribute heat transferred to the aerosol-forming substrate to improve a tobacco taste. In some embodiments, the heat conducting material may also serve as a susceptor that is heated by an induction heating type heater.

Next, the filter portion 120 may serve as a filter for an aerosol generated in the aerosol-forming substrate portion 110. The aerosol that has passed through the filter portion 120 may be inhaled by the user through the oral region of the user.

The filter portion 120 may be connected to a downstream end portion of the aerosol-forming substrate portion 110 and may form a downstream end of the aerosol-generating article 100. A downstream end of the filter portion 120 may serve as a mouthpiece (portion) that comes in contact with the user's lips. For example, the filter portion 120 and the aerosol-forming substrate portion 110 may have a cylindrical shape and be aligned in the longitudinal direction, and an upstream end portion of the filter portion 120 may be connected to the downstream end portion of the aerosol-forming substrate portion 110. As mentioned above, the filter portion 120 and the aerosol-forming substrate portion 110 may be connected by a tipping wrapper, but the scope of the present disclosure is not limited thereto.

The filter portion 120 may include a filter material. Also, the filter portion 120 may further include a filter wrapper that wraps around the filter material. For example, the filter material may be cellulose acetate fibers (i.e., tow), but is not limited thereto. The filter portion 120 may also include at least one capsule (not illustrated). For example, the capsule may be a spherical or cylindrical capsule in which a flavoring liquid is wrapped by a film.

The filter portion 120 may have a single filter structure or a multi-filter structure. The filter portion 120 may also include a cavity formed between a plurality of filter portions. In some embodiments, a downstream end portion of the filter portion 120 may be manufactured as a recessed filter. In this way, a detailed structure of the filter portion 120 may be modified in various ways.

In some embodiments, the resistance to draw of the filter portion 120 or mouthpiece portion may be in a range of 90 mm WG to 140 mm WG. Within such numerical ranges, the inhaling sensation and tobacco smoke taste of the aerosol-generating article 100 were confirmed to be enhanced.

Next, the wrapper 130 may be a porous or nonporous wrapping material that wraps around the components of the aerosol-generating article 100. Although not clearly illustrated, the wrapper 130 may correspond to a separate wrapper such as the wrapper of the aerosol-forming substrate portion 110, the filter wrapper of the filter portion 120, or the tipping wrapper or may refer to the wrapper of the aerosol-generating article 100 that includes all the separate wrappers.

In some embodiments, the wrapper 130 may have a thickness in a range of about 40 μm to 80 μm and a porosity in a range of about 5 CU to 50 CU. However, the scope of the present disclosure is not limited thereto.

Meanwhile, the length, thickness, diameter, shape, or the like of the aerosol-generating article 100 may be designed in various ways. In some embodiments, the aerosol-generating article 100 may have a diameter in a range of about 4 mm to 9 mm and a length in a range of about 45 mm to 50 mm. However, the scope of the present disclosure is not limited to such examples.

The aerosol-generating article 100 according to the first embodiment of the present disclosure has been described above with reference to FIG. 4. Hereinafter, an aerosol-generating article 200 according to a second embodiment of the present disclosure will be described with reference to FIG. 5. Hereinafter, for clarity of the specification, description of contents overlapping with the previous embodiment will be omitted.

FIG. 5 is an exemplary configuration diagram schematically illustrating the aerosol-generating article 200.

As illustrated in FIG. 5, the aerosol-generating article 200 may include an aerosol-forming substrate portion 210, a first filter segment 220, a second filter segment 230, a mouthpiece portion 240, and a wrapper 260. Hereinafter, each component of the aerosol-generating article 200 will be described.

The aerosol-forming substrate portion 210 may correspond to the aerosol-forming substrate portion 110 illustrated in FIG. 4. Thus, description thereof will be omitted.

Next, the first filter segment 220 may be a tubular structure including a hollow 220H or a channel 220H formed therein. An outer diameter of the first filter segment 220 may be in a range of about 3 mm to 10 mm, e.g., about 7 mm. The hollow 220H included in the first filter segment 220 may have a suitable diameter within a range of about 2 mm to 4.5 mm, but the diameter is not limited thereto.

The first filter segment 220 may be manufactured using cellulose acetate. Accordingly, when the heater 1300 of the aerosol generation device 1000 is inserted into the aerosol-generating article 200, a material inside the aerosol-forming substrate portion 210 is prevented from being pushed backwards (that is, in a downstream direction) as the aerosol-forming substrate portion 210 is supported, and an aerosol cooling effect may also be provided. In a case in which the first filter segment 220 serves to support the aerosol-forming substrate portion 210, the first filter segment 220 may also be referred to as "support segment."

Next, the second filter segment 230 may abut the first filter segment 220 and may be disposed between the first filter segment 220 and the mouthpiece portion 240. The second filter segment 230 may serve as a cooling member that cools a high-temperature aerosol formed due to the heater 1300 heating the aerosol-forming substrate portion 210. To emphasize the role of the second filter segment 230 as the cooling member, the second filter segment 230 may also be referred to as "cooling segment." As the second filter segment 230 cools the high-temperature aerosol, the amount of generated aerosol may be increased, and the user may inhale the aerosol cooled to a suitable temperature.

In some embodiments, as illustrated in FIG. 5, the second filter segment 230 may also be a tubular structure including a hollow 230H or a channel 230H formed therein, like the first filter segment 220. The hollow 230H may serve as a path through which an aerosol passes. The shape of the cross-section of the hollow may be polygonal or circular, but the size and shape of the hollow are not limited thereto.

In the above-described embodiment, a diameter of the second filter segment 230 may be in a range of 7 mm to 9 mm, e.g., about 7.9 mm. Also, an inner diameter of the second filter segment 230 may be in a range of about 3.0 mm to 5.5 mm, e.g., about 4.2 mm. Here, the inner diameter of the second filter segment 230 may be larger than an inner diameter of the first filter segment 220. For example, the inner diameter of the first filter segment 220 may be about 2.5 mm while the inner diameter of the second filter segment 230 is about 4.2 mm. Since the inner diameter of the first filter segment 220 and the inner diameter of the second filter segment 230 are different from each other, mainstream smoke flowing in the hollow 220H of the first filter segment 220 and the hollow 230H of the second filter segment 230 may be diffused. Since directionality of the diffused mainstream smoke in the downstream direction of the aerosol-generating article 200 is reduced, the area and time of contact between the mainstream smoke and outside air, which flows into the second filter segment 230, may be increased. Accordingly, a mainstream smoke cooling effect may be improved.

The second filter segment 230 may be manufactured using a material that allows an outside gas to enter the hollow of the second filter segment 230 or may include perforations. The material may be a mixture of a plurality of materials. For example, the material may be cellulose acetate tow, but is not limited thereto.

In some embodiments, the second filter segment 230 may be manufactured using an extrusion method or a fiber weaving method. The second filter segment 230 may be manufactured in various forms to increase a surface area per unit area (that is, a surface area that comes in contact with an aerosol).

For example, the second filter segment 230 may be manufactured by weaving polymer fibers. In this case, a flavoring liquid may be applied on fibers made of polymers. Alternatively, separate fibers on which a flavoring liquid is applied and fibers made of polymers may be woven together to manufacture the second filter segment 230.

For example, the second filter segment 230 may be manufactured using a polymer material or a biodegradable polymer material. Examples of the polymer material include gelatin, polyethylene (PE), polypropylene (PP), polyurethane (PU), fluorinated ethylene propylene (FEP), and a combination thereof, but the polymer material is not limited thereto. Also, examples of the biodegradable polymer material include polylactic acid (PLA), polyhydroxybutyrate (PHB), cellulose acetate, poly-ε-caprolactone (PCL), polyglycolic acid (PGA), polyhydroxyalkanoates (PHAs), and a starch-based thermoplastic resin, but the biodegradable polymer material is not limited thereto.

In some embodiments, a process of wrapping an outer portion of the second filter segment 230 with a wrapper made of paper or a polymer material may be additionally performed. Here, examples of the polymer material may include gelatin, polyethylene (PE), polypropylene (PP), polyurethane (PU), fluorinated ethylene propylene (FEP), and a combination thereof, but the polymer material is not limited thereto.

In some embodiments, the second filter segment 230 may be formed by rolling a porous paper sheet. That is, a rolled porous paper sheet may be disposed inside the second filter segment 230 to allow an air flow (e.g., an aerosol) to pass along a length direction of the second filter segment 230.

Next, the mouthpiece portion 240 may form a downstream end of the aerosol-generating article 200 and serve as a mouthpiece that finally delivers the aerosol, which is delivered from upstream, to the user. In some embodiments, the mouthpiece portion 240 may be a cellulose acetate filter. Although not illustrated, the mouthpiece portion 240 may be manufactured as a recessed filter.

In some embodiments, the mouthpiece portion 240 may include at least one capsule (not illustrated). For example, the capsule may be a spherical or cylindrical capsule in which a flavoring liquid is wrapped by a film.

Materials forming the film of the capsule may be starch and/or a gellant. For example, gellan gum or gelatin may be used as the gellant. Also, a gelation auxiliary agent may be further used as a material forming the film of the capsule. Here, as the gelation auxiliary agent, for example, calcium chloride may be used. Also, a plasticizer may be further used as a material forming the film of the capsule. Here, as the plasticizer, glycerin and/or sorbitol may be used. Also, a coloring agent may be further used as a material forming the film of the capsule.

A flavoring such as menthol and essential oil of plants may be included in the liquid filled in the capsule. In some embodiments, as a solvent of the flavoring included in the liquid filled in the capsule, for example, a medium chain fatty acid triglyceride (MCTG) may be used. The liquid may also contain other additives such as coloring, an emulsifier, and a thickener.

In some embodiments, the mouthpiece portion 240 may be a transfer jet nozzle system (TJNS) filter in which a flavoring is dispersed in the filter itself. Alternatively, separate fibers on which a flavoring liquid is applied may be inserted into the mouthpiece portion 240.

In some embodiments, the resistance to draw of the mouthpiece portion 240 may be in a range of 90 mm WG to 140 mm WG. Within such numerical ranges, the inhaling sensation and tobacco smoke taste of the aerosol-generating article 200 were confirmed to be enhanced.

Next, the wrapper 260 may be a porous wrapping material or nonporous wrapping material that wraps around the components of the aerosol-generating article 200. For example, the wrapper 260 may have a thickness in a range of about 40 μm to 80 μm and a porosity in a range of about 5 CU to 50 CU, but the wrapper 260 is not limited thereto. The wrapper 260 may correspond to separate wrappers of the aerosol-forming substrate portion 210 or filter segments 220 to 240 or may refer to the wrapper of the aerosol-generating article 200 that includes all the separate wrappers.

The aerosol-generating article 200 according to the second embodiment of the present disclosure has been described above with reference to FIG. 5. Hereinafter, an aerosol-generating article 300 according to a third embodiment of the present disclosure will be described with reference to FIG. 6.

FIG. 6 is an exemplary configuration diagram schematically illustrating the aerosol-generating article 300.

Referring to FIG. 6, unlike the aerosol-generating articles 100 and 200 described above with reference to FIGS. 4 and 5, the aerosol-generating article 300 may further include a first filter segment 350 that abuts an aerosol-forming substrate portion 310 upstream of the aerosol-forming substrate portion 310. To emphasize the positional feature, the first filter segment 350 may also be referred to as "front-end filter segment."

The aerosol-forming substrate portion 310 may correspond to the aerosol-forming substrate portion 110 of FIG. 4 or the aerosol-forming substrate portion 210 of FIG. 5, a second filter segment 320 may correspond to the first filter segment 220 or the second filter segment 230 of FIG. 5, and a mouthpiece portion 340 and a wrapper 360 may respectively correspond to the mouthpiece portion 240 and wrapper 260 of FIG. 5. Therefore, descriptions thereof will be omitted, and description will be continued focusing on the first filter segment 350.

The first filter segment 350 may prevent the aerosol-forming substrate portion 310 from falling out of the aerosol-generating article 300 and may also prevent a liquefied aerosol from flowing from the aerosol-forming substrate portion 310 into the aerosol generation device 1000 (see FIGS. 1 to 3) during smoking.

In some embodiments, the first filter segment 350 may be manufactured using cellulose acetate. As illustrated in FIG. 6, the first filter segment 350 may also include a channel 350H that extends from an upstream end portion toward a downstream end portion. For example, the channel 350H may be disposed at the center of the first filter segment 350, but is not limited thereto. In a case in which the first filter segment 350 includes the channel 350H, since an aerosol that enters through the upstream end portion of the first filter segment 350 may easily exit through the downstream end portion of the first filter segment 350, the user may easily inhale the aerosol.

Meanwhile, FIG. 6 illustrates an example in which the shape of the cross-section of the channel 350H is circular, but the shape of the cross-section of the channel 350H is not limited thereto. For example, the cross-section of the channel 350H may have a multi-lobed shape such as a trilobate shape.

The length or diameter of the first filter segment 350 may be variously determined according to the form of the aerosol-generating article 300. For example, a suitable value within a range of 4 mm to 20 mm may be employed as the length of the first filter segment 350. Preferably, the length of the first filter segment 350 may be about 7 mm, but is not limited thereto. Also, for example, a suitable value within a range of 4 mm to 10 mm may be employed as the diameter of the first filter segment 350. Preferably, the diameter of the first filter segment 350 may be about 7 mm, but is not limited thereto.

The aerosol-generating article 300 according to the third embodiment of the present disclosure has been described above with reference to FIG. 6. Hereinafter, an aerosol-generating article 400 according to a fourth embodiment of the present disclosure will be described with reference to FIG. 7.

FIG. 7 is an exemplary configuration diagram schematically illustrating the aerosol-generating article 400.

As illustrated in FIG. 7, the aerosol-generating article 400 may include an aerosol-forming substrate portion 410, a filter segment 420, a mouthpiece portion 430, and a wrapper 440. Also, the aerosol-forming substrate portion 410 may include a first substrate segment 411 and a second substrate segment 412.

The first substrate segment 411 may not include a tobacco material. That is, the first substrate segment 411 may include an aerosol-forming substrate without the tobacco material. For example, the first substrate segment 411 may not include shredded tobacco leaves. Also, the first substrate segment 411 may include at least one of glycerin, propylene glycol, ethylene glycol, dipropylene glycol, diethylene glycol, triethylene glycol, tetraethylene glycol, and oleyl alcohol, but is not limited thereto. Also, the first substrate segment 411 may contain other additives such as a flavoring agent, a wetting agent (that is, a moisturizer), and/or an organic acid. Also, the first substrate segment 411 may contain a flavoring liquid such as menthol or a moisturizer.

The first substrate segment 411 may include a crimped sheet, and the aerosol-forming substrate may be included in the first substrate segment 411 in a state of being impregnated in the crimped sheet. Also, the other additives such as the flavoring agent, wetting agent, and/or organic acid and the flavoring liquid may be included in the first substrate segment 411 in a state of being absorbed into the crimped sheet.

The crimped sheet may be a sheet made of a polymer material. Examples of the polymer material may include at least one of paper, cellulose acetate, lyocell, and polylactic acid. For example, the crimped sheet may be a paper sheet that does not cause an off-flavor due to heat even when heated at a high temperature. However, the crimped sheet is not limited thereto.

A suitable value within a range of 4 mm to 12 mm may be employed as a length of the first substrate segment 411, but the length of the first substrate segment 411 is not limited thereto.

Next, the second substrate segment 412 may include a tobacco material. For example, the second substrate segment 412 may include shredded tobacco leaves, a reconstituted tobacco sheet, or a combination thereof. Also, the second substrate segment 412 may further include an aerosol-forming substrate such as glycerin and propylene glycol. Also, the second substrate segment 412 may contain other additives such as a flavoring agent, a wetting agent, and/or organic acid. Also, a flavoring liquid such as menthol or a moisturizer may be added to the second substrate segment 412 by being sprayed thereon.

A suitable value within a range of 6 mm to 18 mm may be employed as a length of the second substrate segment 412, but the length of the second substrate segment 412 is not limited thereto.

Meanwhile, since the first substrate segment 411 includes an aerosol-forming substrate without a tobacco material while the second substrate segment 412 includes an aerosol-forming substrate including a tobacco material (that is, since the components and content of the aerosol-forming substrates are different), it is necessary to heat the first substrate segment 411 and the second substrate segment 412 to different temperatures such that a user feels a preferable smoking sensation. For example, in a case in which the second substrate segment 412 is heated to a temperature suitable for the first substrate segment 411, the user may experience a burnt taste. On the other hand, in a case in which the first substrate segment 411 is heated to a temperature suitable for the second substrate segment 412, a sufficient amount of aerosol may not be generated.

In some embodiment, the first substrate segment 411 and the second substrate segment 412 may be heated to different temperatures using different heaters. For example, when the first substrate segment 411 is heated to A ° C. by a first heater to generate a sufficient amount of aerosol and the second substrate segment 412 is heated to B ° C. by a second heater to heat the tobacco material included in the second substrate segment 412, the user may feel a preferable smoking sensation.

In some other embodiments, the first substrate segment 411 and the second substrate segment 412 may be heated by a single heater (e.g., the heater 1300). In this case, it is difficult to heat the first substrate segment 411 and the second substrate segment 412 to different temperatures. Therefore, to allow the temperature of the first substrate segment 411 and the temperature of the second substrate segment 412 to rise to suitable temperatures even when the first substrate segment 411 and the second substrate segment 412 are heated by a single heater, at least one of a wrapper of the first substrate segment 411 and a wrapper of the second substrate segment 412 may include a heat conducting material.

The first substrate segment 411 and the second substrate segment 412 may include an aerosol-forming substrate, and the aerosol-forming substrate may include a moisturizer. Examples of the moisturizer may include glycerin, propylene glycol, or a combination thereof, but the moisturizer is not limited thereto. In a case in which glycerin and propylene glycol are combined to constitute a moisturizer, a ratio at which glycerin and propylene glycol are combined may be 8:2. However, the combination ratio is not limited thereto.

The moisturizer included in the first substrate segment 411 may affect the amount of the generated aerosol. In other words, the overall vapor production of the aerosol-generating article 400 may be determined by the weight of the moisturizer included in the first substrate segment 411. Meanwhile, the moisturizer included in the second substrate segment 412 may affect a tobacco smoke taste of the aerosol-generating article 400. In other words, the tobacco smoke taste of the aerosol-generating article 400 may be determined by the tobacco material and moisturizer included in the second substrate segment 412.

For sufficient vapor production of the aerosol-generating article 400, a sufficient amount of moisturizer should be included in the first substrate segment 411. Therefore, preferably, a larger amount of moisturizer may be included in the first substrate segment 411 as compared to the second substrate segment 412. However, in a case in which an excessive amount of moisturizer is included in the first substrate segment 411, the moisturizer may flow out of the aerosol-generating article 400. This may not be preferable in terms of an exterior of the aerosol-generating article 400.

Meanwhile, in some embodiments, an aerosol may be generated when at least a portion of the first substrate segment 411 and at least a portion 121 of the second substrate segment 412 are heated by a heater (e.g., the heater 1300). The formed aerosol may move along a downstream portion of the aerosol-generating article 400 and be finally delivered to the user. Here, a downstream portion of the second substrate segment 412 may not be heated by the heater, and in this case, there may be an effect of filtering some materials of the aerosol as the aerosol passes through the downstream portion. Here, "filtering" may not only refer to a case in which some components included in an aerosol are filtered, but also refer to a case in which other components are added into the aerosol. That is, the unheated portion of the second substrate segment 412 may cause a change in components of an aerosol. For example, as an aerosol passes through the unheated portion, some components in the aerosol may be filtered, or some components included in the unheated portion may be added into the aerosol. Therefore, components of the aerosol discharged to the outside of the aerosol-generating article 400 may be different from components of the initially-generated aerosol, and thus the user may feel a different smoking sensation as compared to when the entire second substrate segment 412 is heated.

Next, the filter segment 420 may have an aerosol cooling effect. Therefore, the user may inhale the aerosol cooled to a suitable temperature. For example, the filter segment 420 may be manufactured using cellulose acetate and may be a tubular structure including a hollow 420H formed therein. For example, the filter segment 420 may be manufactured by adding a plasticizer (e.g., triacetin) to cellulose acetate tow. For example, the filter segment 420 may have 5.0 mono denier and 28,000 total denier, but is not limited thereto. As another example, the filter segment 420 may be manufactured using paper and may be a tubular structure including a hollow 420H formed therein.

A suitable value within a range of 4 mm to 8 mm may be employed as a diameter of the hollow included in the filter segment 420, but the diameter of the hollow is not limited thereto. A suitable value within a range of 4 mm to 30 mm may be employed as length of the filter segment 420, but the length of the filter segment 420 is not limited thereto.

The filter segment 420 is not limited to the above examples, and any other filter segment may be used without limitation as long as the filter segment can perform an aerosol cooling function. The filter segment 420 may also be referred to as a cooling segment 420. Also, the filter segment 420 may correspond to the second filter segment 230 of FIG. 5.

Next, the mouthpiece portion 430 may be manufactured by adding a plasticizer (e.g., triacetin) to cellulose acetate tow. For example, the mouthpiece portion 430 may have 9.0 mono denier and 25,000 total denier, but is not limited thereto. A suitable value within a range of 4 mm to 30 mm may be employed as a length of the mouthpiece portion 430, but the length of the mouthpiece portion 430 is not limited thereto.

The mouthpiece portion 430 and the wrapper 440 may respectively correspond to the mouthpiece portions 120, 240, and 340 and the wrappers 130, 260, and 360 of the previous embodiments. Thus, further descriptions thereof will be omitted.

The aerosol-generating article 400 according to the fourth embodiment of the present disclosure has been described above with reference to FIG. 7. Hereinafter, methods of manufacturing the above-described aerosol-generating articles 100 to 400 and shredded tobacco leaves will be described with reference to FIGS. 8 to 10. In the following description, an aerosol-forming substrate portion, a filter portion, and a mouthpiece portion may respectively correspond to the aerosol-forming substrate portion 110, 210, 310, or 410, the filter portion 120, and the mouthpiece portion 120, 240, 340, or 430. However, for convenience of description, the reference numerals will be omitted. The filter portion may also correspond to the filter segments 220, 230, 320, 350, and 420.

FIG. 8 is an exemplary flowchart illustrating a method of manufacturing an aerosol-generating article according to some embodiments of the present disclosure. However, this is only a preferred embodiment for achieving the objectives of the present disclosure, and, of course, some steps may be added or deleted as necessary.

As illustrated in FIG. 8, the manufacturing method may start with manufacturing shredded tobacco leaves (S20). This step will be described in detail below with reference to FIG. 9.

In step S40, the manufactured shredded tobacco leaves may be used to manufacture an aerosol-forming substrate portion. Specifically, an aerosol-forming rod, which is manufactured by wrapping an aerosol-forming substrate including shredded tobacco leaves with a wrapping material (that is, a wrapper), may be cut into pieces of a predetermined length to form a plurality of aerosol-forming substrate portions. For example, six aerosol-forming substrate portions may be formed by cutting the aerosol-forming rod.

In some embodiments, shredded tobacco leaves may be wrapped with a wrapping material, in which an adhesive is applied on at least a portion of an inner surface, to manufacture an aerosol-forming rod. The adhesive may prevent the shredded tobacco leaves from sticking out during the manufacturing process and thus improve workability. For example, when cutting the aerosol-forming rod, the shredded tobacco leaves may be prevented from sticking out from cut portions. Also, when combining the aerosol-forming substrate portion and the filter portion, the shredded tobacco leaves may be prevented from sticking out from an upstream end of the aerosol-forming substrate portion.

Meanwhile, since the shredded tobacco leaves content in the aerosol-forming substrate portion is closely related to manufacturing costs and a tobacco taste, appropriately controlling the content of shredded tobacco leaves may be important.

In some embodiments, the shredded tobacco leaves content may be in a range of about 140 mg to 210 mg. Preferably, the content may be in a range of about 150 mg to 200 mg or 150 mg to 190 mg. More preferably, the content may be in a range of about 160 mg to 180 mg or 165 mg to 175 mg or may be about 170 mg. Within such numerical ranges, a smooth air flow path and a tobacco taste may be secured, and the cost reduction effect may also be maximized. Further, the sticking-out phenomenon may also be reduced during the manufacturing process. Refer to Experimental Examples 2-1 and 2-2 for further details.

In step S60, the filter portion may be manufactured. Specifically, a plurality of filter portions may be manufactured by cutting a filter rod, which is manufactured by wrapping a filter material with a filter wrapping material, into pieces of a predetermined length.

Step S60 may be performed independently from Step S20 and Step S40.

In Step S80, the aerosol-forming substrate portion and the filter portion may be combined to manufacture an aerosol-generating article. For example, the aerosol-forming substrate portion and the filter portion may be connected using a tipping wrapper to manufacture an aerosol-generating article.

As a more specific example, in the case of the aerosol-generating article 300 illustrated in FIG. 6, the first filter segment 350, the second filter segment 320, and the mouthpiece portion 340 may be connected to the aerosol-forming substrate portion 310 to manufacture the aerosol-generating article 300.

Meanwhile, Step S20 or Steps S40 to S80 may be performed using automated manufacturing equipment. Since those of ordinary skill in the art should be sufficiently familiar with such manufacturing equipment, description thereof will be omitted.

Hereinafter, the manufacturing of the shredded tobacco leaves (S20) will be described in detail with reference to FIG. 9.

FIG. 9 is an exemplary flowchart illustrating a detailed process of the manufacturing of the shredded tobacco leaves (S20). However, the detailed process of step S20 illustrated in FIG. 9 is only a schematic process provided for convenience of understanding. Thus, it should be noted that some steps may be added, deleted (omitted), or modified according to various factors, and a sequence of the steps may also vary.

As illustrated in FIG. 9, in step S21, raw tobacco leaves may be processed. For example, processing such as threshing, slicing, drying, and conditioning may be performed on tobacco leaves such as bright tobacco leaves, oriental tobacco leaves, and burley tobacco leaves.

In step S23, a first flavoring process may be performed on the processed tobacco leaves. The first flavoring process may refer to a process of adding a flavoring to improve inherent physicochemical properties of the tobacco leaves and to eliminate an off-taste. For example, in this step, an additive including a flavoring may be uniformly sprayed onto the processed tobacco leaves. Here, for example, the additive may include a moisturizer. Also, for example, the moisturizer may include glycerin and propylene glycol.

In some embodiments, the moisturizer content in the additive may be, preferably, in a range of about 9% (wt %) to 12% or may be, more preferably, about 10%.

Also, in some embodiments, a weight ratio between glycerin and propylene glycol, which are included in the moisturizer, may be in a range of about 1:1 to 8:2. Preferably, the weight ratio may be in a range of about 3:2 to 8:2 or 2:1 to 8:2, and more preferably, the weight ratio may be in a range of about 2:1 to 8:3 or may be about 7:3. Within such numerical ranges, vapor production was confirmed to be enhanced. Refer to Experimental Example 3 for further details.

In step S25, the firstly-flavored tobacco leaves may be mixed. For example, for flavor balance or moisture balance, the firstly-flavored tobacco leaves may be mixed in silo equipment.

In step S27, the mixed tobacco leaves may be cut according to a predetermined cutting width. For example, the tobacco leaves may be cut according to a predetermined cutting width through a cutter including one or more cutting knives. Here, the form, cutting width, and the like of the cutting knives may vary according to an embodiment.

In some embodiments, a cutting blade of the cutting knife may be formed in the shape of a quadrilateral saw blade. For example, FIG. 10 illustrates a process of cutting tobacco leaves 510 through a rotary cutter 520 including a plurality of cutting knives 521. As illustrated, a cutting blade of the cutting knife 521 may be formed in the shape of a quadrilateral saw blade instead of being formed in a linear shape. In this case, the tobacco leaves may be cut to a uniform length, such that the shredded tobacco leaves do not have a length longer than a predetermined cutting width. However, in some other embodiments, a cutting blade of a cutting knife may be formed in a linear shape.

In some embodiments, the cutting width of the tobacco leaves may be in a range of about 1.0 mm to 1.5 mm. Preferably, the cutting width may be in a range of about 1.0 mm to 1.4 mm or 1.1 mm to 1.5 mm. More preferably, the cutting width may be in a range of about 1.1 mm to 1.3 mm or may be about 1.2 mm. It was confirmed that, within such numerical ranges, a smooth air flow path may be secured to enhance vapor production (amount of generated aerosol), and the sticking-out phenomenon may also be reduced. Refer to Experimental Examples 1-1 and 1-2 for further details.

In some embodiments, after step S27, processes such as drying and cooling may be further performed.

In step S29, a second flavoring process may be performed on the cut tobacco leaves, and as a result, shredded tobacco leaves to be included in an aerosol-forming rod may be formed. Here, the second flavoring process is a flavoring process performed after the first flavoring process and may be performed to impart a flavor to the final tobacco product (e.g., aerosol-generating article). For example, the second flavoring process may be performed by adding an additive including a flavoring to the cut tobacco leaves.

In some embodiments, the moisture content in the shredded tobacco leaves after the second flavoring process may be in a range of about 11.5% to 17.5% of the total weight of the shredded tobacco leaves. Preferably, the moisture content may be in a range of about 12% to 17% or 12% to 16%. More preferably, the moisture content may be in a range of about 13% to 16%, or even more preferably, the moisture content may be in a range of about 14% to 15% or may be about 14.5%. It was confirmed that, within such numerical ranges, a smooth air flow path is secured and vapor production is enhanced. Refer to Experimental Example 3 for further details.

In some embodiments, a moisturizer (e.g., glycerin) may be added to the cut tobacco leaves during the second flavoring process, and the amount of added moisturizer may be in a range of about 1 wt % to 5 wt % of the total weight of the cut tobacco leaves (that is, shredded tobacco leaves) (e.g., about 1 kg to 5 kg of glycerin may be added per 100 kg of shredded tobacco). Preferably, the added amount may be in a range of about 2 wt % to 4 wt %, and more preferably, the added amount may be about 3 wt %. It was confirmed that, within such numerical ranges, vapor production of the aerosol-generating article is further enhanced and an off-taste is significantly reduced. Refer to Experimental Examples 6-1 and 6-2 for further details.

The methods of manufacturing the aerosol-generating article and shredded tobacco leaves have been described above with reference to FIGS. 8 to 10. Hereinafter, the configurations mentioned herein and the advantageous effects according thereto will be described in more detail using examples and comparative examples. However, the following examples are only some of various examples of the present disclosure, and thus the scope of the present disclosure is not limited by the examples.

Comparative Example 1

A heating-type aerosol-generating article (that is, a cigarette) having the same structure as the aerosol-generating article 300 illustrated in FIG. 6 was manufactured. Specifically, about 270 mg of a reconstituted tobacco slurry was added to manufacture an aerosol-forming substrate portion, and the glycerin content in the reconstituted tobacco slurry was about 10%. For reference, commercially available aerosol-generating articles also include about 270 mg of shredded reconstituted tobacco slurry, and the glycerin content in the reconstituted tobacco slurry is about 10%.

Examples 1 to 5

Aerosol-generating articles according to Examples 1 to 5 (which have the same physical specifications as the aerosol-generating article of Comparative Example 1) were manufactured using shredded tobacco leaves instead of using a reconstituted tobacco slurry. In particular, a cutter was set according to numerical values listed in Table 1 below, and shredded tobacco leaves having different cutting widths were manufactured. During manufacture of the shredded tobacco leaves, a moisturizer (which contained glycerin and propylene glycol at a ratio of 7:3) was added such that the moisture content is about 10%, and the moisture content in the shredded tobacco leaves after a second flavoring process was controlled to be about 14.5%. Also, about 170 mg of the cut shredded tobacco leaves was added and a mouthpiece-side filter (e.g., the mouthpiece portion 340 of FIG. 6), whose resistance to draw was in a range of about 90 mm WG to 140 mm WG, was used to manufacture the aerosol-generating articles according to Examples 1 to 5.

TABLE 1

| Classification | Cutting width (mm) |
|---|---|
| Example 1 | 0.7 mm |
| Example 2 | 0.9 mm |
| Example 3 | 1.2 mm |
| Example 4 | 1.5 mm |
| Example 5 | 1.8 mm |

Experimental Example 1-1: Evaluation of Vapor Production According to Cutting Width Sensory evaluation relating to vapor production was performed for the aerosol-generating articles according to Comparative Example 1 and Examples 1 to 5. The sensory evaluation was carried out by a panel of thirty evaluators who have smoked for five years or more, and a score was given to vapor production based on a scale of 1 to 5. Also, to reduce an evaluation error, the average of the scores given by the panel, excluding the lowest and highest scores, was calculated as the final vapor production score of the corresponding aerosol-generating article. The results of the sensory evaluation relating to vapor production are illustrated in FIG. 11.

Referring to FIG. 11, vapor production was found to be the highest in the case in which the cutting width was 1.2 mm (e.g., Example 3). In particular, the vapor production in Example 3 was found to be higher than vapor production in Comparative Example 1 in which reconstituted tobacco leaves were added. Also, it was found that vapor production generally decreased with a decrease in the cutting width (e.g., Examples 1 and 2). This is because a smaller cutting width reduces the pores in the aerosol-forming substrate portion and thus makes it difficult to form an air flow path for smooth air movement. Also, it was found that vapor production decreased when the cutting width was increased beyond a predetermined value (e.g., Examples 4 and 5). This is because the shredded tobacco leaves were not uniformly cut, which caused pores (e.g., the size and distribution of pores) to be non-uniform. As a result, non-uniformity of vapor production negatively affected the panel's evaluation of vapor production when the cutting width is set to a predetermined value or more (e.g., 1.5 mm or more).

According to the evaluation results, it can be seen that it is preferable to set the cutting width of the shredded tobacco leaves to be 0.9 mm or more and 1.5 mm or less in order to ensure vapor production that a user will be satisfied with.

Experimental Example 1-2: Evaluation of Degree of Sticking-Out According to Cutting Width A degree to which the shredded tobacco leaves stick out during manufacture of the aerosol-generating articles according to Examples 1 to 5 was measured. Also, to identify an effect of an adhesive, an additional experiment in which an adhesive was applied on a wrapping material and the degree of sticking-out was measured was conducted during manufacture of the aerosol-generating articles according to Examples 2 to 4. The experimental results are shown in Table 2 below. For reference, in Table 2 below, the measurement unit (mg/cm2) of the degree of sticking-out refers to a value obtained by dividing a weight of shredded tobacco leaves that fall out due to the sticking-out phenomenon by a cross-sectional area of the aerosol-generating article.

TABLE 2

| Classification | Sticking-out (mg/cm$^2$) |
|---|---|
| Example 1 | 45.9 |
| Example 2 | 35.9 |
| Example 3 | 23.1 |
| Example 4 | 19.2 |
| Example 5 | 15.2 |
| Example 2 + Adhesive | 27.3 |
| Example 3 + Adhesive | 11.8 |
| Example 4 + Adhesive | 10.1 |

Referring to Table 2, it was found that the degree of sticking-out decreased with an increase in the cutting width of the shredded tobacco leaves. This is because it is easier for the thinner shredded tobacco leaves (that is, when the cutting width is smaller) to stick out and it is harder for the thicker shredded tobacco leaves to stick out. In this way, it can be seen that it is preferable to set the cutting width of the shredded tobacco leaves to be 0.9 mm or more in order to improve workability.

Also, the degree of sticking-out was found to be significantly reduced when an adhesive was applied on the wrapping material, and this indicates that workability can be significantly improved when the adhesive is applied.

Examples 6 to 9

As shown in Table 3 below, aerosol-generating articles according to Examples 6 to 9 were manufactured by varying the shredded tobacco leaves content. The shredded tobacco leaves of Examples 6 to 9 were manufactured in the same way as in Example 3.

TABLE 3

| Classification | Shredded tobacco content (mg) |
|---|---|
| Example 3 | 170 mg |
| Example 6 | 130 mg |
| Example 7 | 150 mg |
| Example 8 | 190 mg |
| Example 9 | 210 mg |

Experimental Example 2-1: Evaluation of Vapor Production and Off-Taste (Inherent Tobacco Taste) According to Shredded Tobacco Content Sensory evaluation relating to vapor production and off-taste according to the shredded tobacco leaves content was performed for the aerosol-generating articles according to Example 3 and Examples 6 to 9. An evaluation method was the same as in Experimental Example 1-1 described above, and the evaluation results are illustrated in FIG. 12.

Referring to FIG. 12, an inherent tobacco taste was found to be generally better in the aerosol-generating articles according to the examples as compared to the aerosol-generating article according to Comparative Example 1. This indicates that an off-taste is reduced and an inherent tobacco taste is enhanced in a case in which shredded tobacco leaves are used instead of reconstituted tobacco leaves.

However, vapor production was found to be reduced when the shredded tobacco leaves content was about 190 mg or more (e.g., Examples 8 and 9). This is determined to be due to an air flow path being blocked when an excessive amount of shredded tobacco leaves is added.

Also, an off-taste reduction effect was also reduced when the shredded tobacco leaves content was a predetermined value or more (e.g., Examples 8 and 9). This reduction is determined to be due to an air flow path not being formed well, and thus an inherent taste and flavor of tobacco leaves are not expressed well despite the large amount of shredded tobacco. In this way, it can be seen that setting the shredded tobacco leaves content within a range of about 150 mg to 190 mg is effective. Since such a range is significantly lower than the reconstituted tobacco leaves content (e.g., 270 mg) in commercially available aerosol-generating articles, the manufacturing cost may be reduced.

Experimental Example 2-2: Evaluation of Degree of Sticking-Out According to Shredded Tobacco Content A degree to which the shredded tobacco leaves stick out during manufacture of the aerosol-generating articles according to Examples 6 to 9 was measured. Also, to identify an effect of an adhesive, an additional experiment in which an adhesive was applied on a wrapping material and the degree of sticking-out was measured was conducted during manufacture of the aerosol-generating articles according to Examples 3, 7, and 8. The experimental results are shown in Table 4 below.

TABLE 4

| Classification | Sticking-out (mg/cm$^2$) |
|---|---|
| Example 3 | 23.1 |
| Example 6 | 29.3 |
| Example 7 | 19.1 |
| Example 8 | 17.2 |
| Example 9 | 14.1 |
| Example 3 + Adhesive | 11.8 |
| Example 7 + Adhesive | 10.2 |
| Example 8 + Adhesive | 9.1 |

Referring to Table 4, it was found that the degree of sticking-out tended to reduce with an increase in the shredded tobacco leaves content. This is because the shredded tobacco leaves form a dense mass inside an aerosol-forming rod, making it difficult to stick out. In this way, it can be seen that it is preferable to set the shredded tobacco leaves content to be about 150 mg or more in order to improve workability.

Also, the degree of sticking-out was found to be significantly reduced when an adhesive was applied on the wrapping material, and this indicates that workability can be significantly improved when the adhesive is applied.

Examples 10 to 12

As shown in Table 5 below, aerosol-generating articles according to Examples 10 to 12 were manufactured by varying a composition ratio between glycerin (Gly.) and propylene glycol (PG) when adding a moisturizer (at content of 10%) in the first flavoring process of the shredded tobacco leaves. Other conditions such as the shredded tobacco leaves content were the same as in Example 3.

TABLE 5

| | First flavoring | |
|---|---|---|
| Classification | Gly. | PG |
| Example 3 | 7 | 3 |
| Example 10 | 3 | 7 |
| Example 11 | 5 | 5 |
| Example 12 | 8 | 2 |

Experimental Example 3: Evaluation of Vapor Production According to Gly. to PG Ratio Sensory evaluation relating to vapor production according to a composition ratio between glycerin and propylene glycol was performed for the aerosol-generating articles according to Example 3 and Examples 10 to 12. Also, comparison with Comparative Example 1 was performed. An evaluation method was the same as in Experimental Example 1-1 described above, and the evaluation results are illustrated in FIG. 13.

Referring to FIG. 13, it was found that vapor production tended to generally increase with an increase in the proportion of glycerin, and it was found that vapor production was even higher as compared to Comparative Example 1 in a case in which the ratio between glycerin and propylene glycol was 7:3 (e.g., Example 3). This is because an increase in the glycerin content positively affects vapor production.

In a case in which the proportion of glycerin exceeded about 70% of the moisturizer (e.g., Example 12), it was found that vapor production slightly decreased and reached a value close to vapor production in Comparative Example 1.

Meanwhile, the proportion of glycerin was also confirmed to be related to workability. It was found that, in a case in which the proportion of glycerin was high (e.g., higher than in Example 12), the shredded tobacco leaves formed a mass and workability somewhat decreased, and even in a case in which the proportion of glycerin was too low (e.g., Example 10), workability decreased due to the sticking-out phenomenon of shredded tobacco.

According to such experimental results, it can be seen that it is preferable to set the composition ratio between glycerin and propylene glycol to be in a range of about 1:1 to 8:2 in order to simultaneously improve vapor production and workability.

Examples 13 to 16

As shown in Table 6 below, aerosol-generating articles according to Examples 13 to 16 were manufactured by varying the moisture content in the shredded tobacco leaves. The moisture content in Table 6 below indicates the moisture content right after the second flavoring process, and thus the actual moisture content in shredded tobacco in the aerosol-generating articles may be slightly lower than values listed in Table 6. Other conditions such as the shredded tobacco leaves content were the same as in Example 3.

TABLE 6

| Classification | Moisture content right after second flavoring (wt %) |
|---|---|
| Example 3 | 14.5 |
| Example 13 | 11.5 |
| Example 14 | 13 |
| Example 15 | 16 |
| Example 16 | 17.5 |

Experimental Example 4: Evaluation of Vapor Production According to Moisture Content in Shredded Tobacco Sensory evaluation relating to vapor production according to the moisture content in shredded tobacco leaves was performed for the aerosol-generating articles according to Example 3 and Examples 13 to 16. Also, comparison with Comparative Example 1 was performed. An evaluation method was the same as in Experimental Example 1-1 described above, and the evaluation results are illustrated in FIG. 14.

Referring to FIG. 14, it was found that vapor production generally increased with an increase in the moisture content in the shredded tobacco leaves, and it was found that vapor production was even higher as compared to Comparative Example 1 in a case in which the moisture content was 14.5% (e.g., Example 3). The above results are determined to be due to an increase in the moisture content in the shredded tobacco leaves positively affecting vapor production.

However, it was found that vapor production decreased again if the moisture content in the shredded tobacco leaves exceeds about 16% (e.g., Example 16). This is because the shredded tobacco leaves with higher moisture content easily form a mass, which negatively affects an air flow path.

Meanwhile, the moisture content in the shredded tobacco leaves was also confirmed to be related to workability. It was found that, in a case in which the moisture content was high (e.g., Example 16), the shredded tobacco leaves formed a mass and workability somewhat decreased, and even in a case in which the moisture content was too low (e.g., Example 13), workability somewhat decreased due to the sticking-out phenomenon of shredded tobacco.

According to such experimental results, it can be seen that it is preferable to set the moisture content in the shredded tobacco leaves (right after the second flavoring process) to be in a range of about 12% to 17% in order to simultaneously improve vapor production and workability.

Experimental Example 5-1: Comprehensive Sensory Evaluation for Example 3 and Comparative Example 1

Comprehensive sensory evaluation was performed for the aerosol-generating articles according to Example 3 and Comparative Example 1. Sensory evaluation was performed for vapor production, tobacco smoke taste intensity, irritation, inhaling sensation, and off-taste (inherent tobacco taste) as evaluation items, and an evaluation method was the same as in Experimental Example 1-1 described above. The evaluation results relating to this experimental example are illustrated in FIG. 15.

Referring to FIG. 15, the aerosol-generating article according to Example 3 was found to be superior to Comparative Example 1 in terms of vapor production, inhaling sensation, and off-taste as. This is because an air flow path was formed well by adding an appropriate amount of shredded tobacco leaves which are cut according to a suitable cutting width and appropriately controlling the moisture content in the shredded tobacco leaves and the composition ratio of the moisturizer. It is determined that the inhaling sensation would have also been affected by low resistance to draw of a mouthpiece-side filter.

Meanwhile, the aerosol-generating article according to Comparative Example 1 was found to be superior to Example 3 in terms of tobacco smoke taste intensity and irritation. This is due to a somewhat low proportion of propylene glycol in the shredded tobacco leaves.

Overall, it can be confirmed that the aerosol-generating article according to Example 3 is superior as compared to Comparative Example 1. In this way, it can be seen that aerosol-generating articles based on shredded tobacco leaves can sufficiently replace articles based on shredded reconstituted tobacco leaves. Further, since the aerosol-generating article according to Example 3 also has higher price competitiveness than the article based on shredded reconstituted tobacco leaves (e.g., Comparative Example 1), it can be seen that the aerosol-generating article according to Example 3 also has sufficient market competitiveness.

Experimental Example 5-2: Aerosol Component Analysis for Example 3 and Comparative Example 1

For more objective and quantitative evaluation, aerosol component analysis was performed for the aerosol-generating articles according to Example 3 and Comparative Example 1. Specifically, smoke components of mainstream smoke were analyzed during smoking of aerosol-generating articles that had been manufactured two weeks before. The smoke for component analysis was repeatedly collected four times for each sample, based on eight puffs each time. The component analysis results were derived on the basis of the average values of three collection results. Also, smoking was performed according to Health Canada (HC) smoking conditions using a non-burning type automatic smoking device in a smoking room with a temperature of about 20° C. and humidity of about 62.5%. The component analysis results according to this experimental example are shown in Table 7 below.

TABLE 7

| | Components of aerosol (mg/cig) | | | | | |
|---|---|---|---|---|---|---|
| Classification | TPM | Tar | Nic | PG | Gly. | Moisture |
| Comparative Example 1 | 45.8 | 22.6 | 0.79 | 4.7 | 7.9 | 22.4 |
| Example 3 | 41.4 | 22.2 | 0.77 | 4.0 | 8.3 | 23.3 |

Referring to Table 7, it can be seen that migration amounts of nicotine and tar of the aerosol-generating article according to Example 3 are almost the same as in Comparative Example 1. This indicates that, even when shredded tobacco leaves are applied to a heating-type aerosol-generating article, a user may experience a similar tobacco smoke taste as when using an article based on reconstituted tobacco leaves. Of course, in view of the sensory evaluation, since shredded tobacco leaves can further reduce an off-taste as compared to reconstituted tobacco leaves, it is determined that the actual tobacco smoke taste experienced by a user would be better when using an article based on shredded tobacco leaves (e.g., Example 3) than when using an article based on reconstituted tobacco leaves (e.g., Comparative Example 1).

Also, glycerin and moisture were found to be slightly increased, which shows that vapor production increased. Also, propylene glycol was found to be slightly decreased, which shows that the tobacco smoke taste intensity and irritation of the aerosol-generating article according to Example 3 were somewhat lower as compared to Comparative Example 1.

For reference, an aerosol-generating article was manufactured with the same conditions as in Example 3 except that shredded tobacco leaves and a shredded reconstituted tobacco slurry were mixed at a ratio of about 8:2. Sensory evaluation and aerosol component analysis were performed for the manufactured aerosol-generating article, and the experimental results were confirmed to be similar as in Example 3.

Examples 17 to 21

As shown in Table 8 below, shredded tobacco leaves were manufactured by varying the amount of added glycerin during the second flavoring, and aerosol-generating articles according to Examples 17 to 21 were manufactured using the manufactured shredded tobacco leaves. Other conditions such as the shredded tobacco leaves content were the same as in Example 3. For reference, in the case of the shredded tobacco leaves of Example 3, glycerin was not added during the second flavoring.

TABLE 8

| Classification | Amount of added glycerin with respect to total weight of shredded tobacco leaves during second flavoring (wt %) |
|---|---|
| Example 17 | 1% |
| Example 18 | 2% |
| Example 19 | 3% |
| Example 20 | 4% |
| Example 21 | 5% |

Experimental Example 6-1: Comprehensive Sensory Evaluation for Examples 17 to 21 and Comparative Example 1

Comprehensive sensory evaluation was performed for the aerosol-generating articles according to Examples 17 to 21. Sensory evaluation was performed for vapor production, tobacco smoke taste intensity, irritation, inhaling sensation, and off-taste (inherent tobacco taste) as evaluation items, and an evaluation method was the same as in Experimental Example 1-1 described above. The evaluation results relating to this experimental example are shown in Table 9 below.

TABLE 9

| Classification | Vapor production | Tobacco smoke taste intensity | Irritation | Inhaling sensation | Off-taste |
|---|---|---|---|---|---|
| Example 17 | 4.4 | 3.4 | 3.4 | 4.2 | 3.5 |
| Example 18 | 4.5 | 3.4 | 3.2 | 4.2 | 3.4 |
| Example 19 | 4.7 | 3.3 | 3.2 | 4.3 | 3.1 |
| Example 20 | 4.7 | 3.3 | 3.2 | 4.2 | 3.3 |
| Example 21 | 4.7 | 3.3 | 3.1 | 4.1 | 3.3 |
| Comparative Example 1 | 4.2 | 3.5 | 3.7 | 3.9 | 3.5 |

Referring to Table 9, the aerosol-generating articles according to the examples were found to be superior to Comparative Example 1 in terms of vapor production, inhaling sensation, and off-taste reduction. This indicates that, in a case in which a suitable amount of moisturizer is added during the second flavoring, vapor production may be further enhanced and higher-quality shredded tobacco leaves (e.g., shredded tobacco with a reduced off-taste and a rich inherent tobacco taste) may be manufactured. However, it is determined that the inhaling sensation would have also been affected by low resistance to draw of a mouthpiece-side filter.

Also, among the examples, the aerosol-generating article according to Example 19 was found to have generally excellent evaluation scores. For example, the aerosol-generating article according to Example 19 was found to have higher vapor production and less off-taste as compared to other examples. In this way, it can be seen that adding a moisturizer at around 3% during the second flavoring is preferable.

Summing up the sensory evaluation results, it can be confirmed that the aerosol-generating articles according to the examples are generally superior to Comparative Example 1. In this way, it can be seen that aerosol-generating articles based on shredded tobacco leaves can sufficiently replace articles based on shredded reconstituted tobacco leaves.

Experimental Example 6-2: Aerosol Component Analysis for Example 3, Example 19, and Comparative Example 1

For more objective and quantitative evaluation, aerosol component analysis was performed for the aerosol-generating articles according to Example 3, Example 19, and Comparative Example 1. A method of analysis was the same as in Experimental Example 5-2 described above. The component analysis results according to this experimental example are shown in Table 10 below.

TABLE 10

| | Components of aerosol (mg/cig) | | | | | |
|---|---|---|---|---|---|---|
| Classification | TPM | Tar | Nic | PG | Gly. | Moisture |
| Comparative Example 1 | 45.8 | 22.6 | 0.79 | 4.7 | 7.9 | 22.4 |
| Example 3 | 41.4 | 22.2 | 0.77 | 4.0 | 8.3 | 23.3 |
| Example 19 | 45.3 | 25.4 | 0.46 | 3.7 | 12.6 | 24.3 |

Referring to Table 10, it was found that the glycerin component sharply increased in the case of the aerosol-generating article according to Example 19 as compared to Comparative Example 1 and Example 3. This indicates that vapor production may be further enhanced when a moisturizer is appropriately added during the second flavoring. Meanwhile, the nicotine and propylene glycol components were found to be slightly reduced as compared to Comparative Example 1 and Example 3. This shows that the tobacco smoke taste intensity and irritation of the aerosol-generating article according to Example 19 were slightly lower as compared to Comparative Example 1 or Example 3.

The configurations of the aerosol-generating articles manufactured using shredded tobacco leaves and the advantageous effects according thereto have been described in detail using various examples and a comparative example.

The embodiments of the present disclosure have been described above with reference to the accompanying drawings, but those of ordinary skill in the art to which the present disclosure pertains should understand that the present disclosure may be carried out in other specific forms without changing the technical spirit or essential features thereof. Therefore, the embodiments described above should be understood as being illustrative, instead of limiting, in all aspects. The scope of the present disclosure should be interpreted by the claims below, and any technical spirit within the scope equivalent to the claims should be interpreted as falling within the scope of the technical spirit defined by the present disclosure.

What is claimed is:

1. An aerosol-generating article for being inserted into an aerosol generation device and generating an aerosol, comprising:

an aerosol-forming substrate portion which includes only shredded tobacco leaves and is configured to form the aerosol when electrically heated by the aerosol generation device; and a mouthpiece portion which is disposed downstream of the aerosol-forming substrate portion to form a downstream end of the aerosol-generating article, wherein a weight ratio between glycerin and propylene glycol included in the shredded tobacco leaves is in a range of 3:2 to 8:2, wherein a cutting width of the shredded tobacco leaves is in a range of 1.0 mm to 1.4 mm, wherein a shredded tobacco leaves content in the aerosol-forming substrate portion is in a range of 150 mg to 200 mg, and wherein a moisture content in the shredded tobacco leaves is in a range of 14% to 17% of a total weight of the shredded tobacco leaves.

2. The aerosol-generating article of claim 1, wherein:

the shredded tobacco leaves are manufactured through a manufacturing process including a flavoring process;

a moisturizer is added during the flavoring process; and a weight ratio between glycerin and propylene glycol included in the moisturizer is in a range of 3:2 to 8:2.

3. The aerosol-generating article of claim 1, wherein a moisture content in the shredded tobacco leaves is in a range of 14.5% to 17% of a total weight of the shredded tobacco leaves.

4. The aerosol-generating article of claim 1, wherein the aerosol-forming substrate portion further includes a wrapper wrapped around the shredded tobacco leaves, and an adhesive is applied on at least a portion of the wrapper.

5. The aerosol-generating article of claim 1, wherein a resistance to draw of the mouthpiece portion is in a range of 90 mm WG to 140 mm WG.

6. The aerosol-generating article of claim 1, further comprising:

a support segment disposed downstream of the aerosol-forming substrate portion and configured to support the aerosol-forming substrate portion; and a cooling segment disposed between the support segment and the mouthpiece portion and configured to cool the formed aerosol.

7. The aerosol-generating article of claim 1, further comprising:

a first filter segment disposed upstream of the aerosol-forming substrate portion and configured to form an upstream end of the aerosol-generating article; and a second filter segment disposed between the aerosol-forming substrate portion and the mouthpiece portion and including a channel configured to pass the formed aerosol.

8. The aerosol-generating article of claim 1, wherein the aerosol-forming substrate portion includes:

a first substrate segment which does not include the shredded tobacco leaves and includes a moisturizer; and a second substrate segment which is disposed downstream of the first substrate segment and includes the shredded tobacco leaves.

9. The aerosol-generating article of claim 1, wherein:

the shredded tobacco leaves are manufactured through a manufacturing process including a first flavoring process and a second flavoring process performed after the first flavoring process; and an amount of moisturizer added during the second flavoring process is in a range of about 2 wt % to 4 wt % of a total weight of the shredded tobacco leaves.

10. The aerosol-generating article of claim 1, further comprising:

a first filter segment disposed upstream of the aerosol-forming substrate portion and configured to form an upstream end of the aerosol-generating article, a support segment disposed downstream of the aerosol-forming substrate portion and configured to support the aerosol-forming substrate portion; and a cooling segment disposed between the support segment and the mouthpiece portion and configured to cool the formed aerosol.

11. A method of manufacturing the aerosol-generating article of claim 1, the method comprising:

manufacturing shredded tobacco leaves by processing raw tobacco leaves;

forming an aerosol-forming substrate portion by using the manufactured shredded tobacco leaves; and combining the formed aerosol-forming substrate portion and a mouthpiece portion.

12. The method of claim 11, wherein the manufacturing of the shredded tobacco leaves includes cutting the raw tobacco leaves at a cutting width in a range of 1.0 mm to 1.4 mm.

13. The method of claim 11, wherein the manufacturing of the shredded tobacco leaves includes performing flavoring by adding a moisturizer to the raw tobacco leaves, and wherein a weight ratio between glycerin and propylene glycol included in the moisturizer is in a range of 3:2 to 8:2.

14. The method of claim 11, wherein the manufacturing of the shredded tobacco leaves includes:

performing first flavoring on the raw tobacco leaves;

cutting the firstly-flavored raw tobacco leaves; and manufacturing the shredded tobacco leaves by performing second flavoring on the cut raw tobacco leaves, and wherein a moisture content in the manufactured shredded tobacco leaves is in a range of 14% to 17% of a total weight of the shredded tobacco leaves.

15. The method of claim 11, wherein the forming of the aerosol-forming substrate portion includes:

manufacture an aerosol-forming rod by wrapping the manufactured shredded tobacco leaves with a wrapping material in which an adhesive is applied on at least a portion of an inner surface; and forming the aerosol-forming substrate portion by cutting the manufactured aerosol-forming rod to have a predetermined length.

16. The method of claim 11, wherein the manufacturing of the shredded tobacco leaves includes cutting the raw tobacco leaves using a cutter including at least one cutting knife, wherein a cutting blade has a quadrilateral saw blade.

* * * * *